US012758065B2

(12) United States Patent
McClay et al.

(10) Patent No.: US 12,758,065 B2
(45) Date of Patent: Oct. 13, 2026

(54) SURFACE CLEANING APPARATUS

(71) Applicant: SHARKNINJA OPERATING LLC, Needham, MA (US)

(72) Inventors: Casey McClay, Needham, MA (US); Kevin Kelemen, Needham, MA (US); Peter Hutchinson, Needham, MA (US); Matt Windt, Needham, MA (US); Steven Gacin, Needham, MA (US); Mingshun Su, Suzhou (CN); Robert Yang, Suzhou (CN); Jesse Yang, Needham, MA (US); David T. Barker, Snaith (GB); Patrick Cleary, Allston, MA (US); Daniel J. Innes, West Roxbury, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/388,969

(22) Filed: Jul. 29, 2021

(65) Prior Publication Data

US 2022/0031131 A1 Feb. 3, 2022

Related U.S. Application Data

(60) Provisional application No. 63/209,701, filed on Jun. 11, 2021, provisional application No. 63/058,397, filed on Jul. 29, 2020.

(51) Int. Cl.

| | |
|---|---|
| ***A47L 5/28*** | (2006.01) |
| ***A47L 9/02*** | (2006.01) |
| ***A47L 9/32*** | (2006.01) |

(52) U.S. Cl.

CPC ..... *A47L 5/28* (2013.01); *A47L 9/02* (2013.01); *A47L 9/32* (2013.01)

(58) Field of Classification Search

CPC ... A47L 5/225; A47L 5/24; A47L 5/28; A47L 9/02; A47L 9/242; A47L 9/248;

(Continued)

(56) References Cited

U.S. PATENT DOCUMENTS 4,443,910 A * 4/1984 Fitzwater ..... A47L 5/32 15/337
8,296,901 B2 * 10/2012 Rosenzweig ..... A47L 9/242 285/305

(Continued)

FOREIGN PATENT DOCUMENTS

CN 206211613 5/2017
CN 109381110 2/2019

(Continued)

OTHER PUBLICATIONS

Espacenet Translation CN 110141156 Description; Extension Hose for Electric Vacuum Cleaner; Yoshida, M; Aug. 20, 2019 (Year: 2019).*

(Continued)

*Primary Examiner* — Brian D Keller
*Assistant Examiner* — Sidney D Full
(74) *Attorney, Agent, or Firm* — Secant IP, P.L.L.C.

(57) ABSTRACT

A vacuum cleaner may include a body having a handle end and an attachment end, the attachment end being opposite the handle end along a longitudinal axis of the body, a dust cup disposed between the handle end and the attachment end, a suction motor disposed between the handle end and the attachment end, a body latch configured to releasably engage an accessory, and a body toggle configured to cause the body latch to transition between a releasing position and a retaining position, the body toggle being positioned closer to the handle end than the attachment end.

20 Claims, 25 Drawing Sheets

(58) Field of Classification Search
CPC ..... A47L 9/32–327; F16L 35/00; B25G 3/04; B25G 3/12
USPC ..... 285/7, 317, 921; 15/414, 415.1
See application file for complete search history.

(56) References Cited

U.S. PATENT DOCUMENTS

| | | | | |
|---|---|---|---|---|
| 10,702,111 | B2 * | 7/2020 | Tomasiak | A47L 9/02 |
| 2005/0066465 | A1 * | 3/2005 | Minkler | A47L 13/16 15/210.1 |
| 2013/0058635 | A1 | 3/2013 | Vrdoljak | |
| 2013/0152337 | A1 | 6/2013 | Thorne | |
| 2014/0137363 | A1 * | 5/2014 | Wilson | A47L 9/1625 15/347 |
| 2014/0150201 | A1 | 6/2014 | McGee et al. | |
| 2015/0013102 | A1 | 1/2015 | Bilger | |
| 2015/0040340 | A1 | 2/2015 | Bilger et al. | |
| 2015/0135474 | A1 | 5/2015 | Gidwell | |
| 2015/0297054 | A1 | 10/2015 | Weeks et al. | |
| 2015/0351596 | A1 | 12/2015 | Thorne | |
| 2016/0015228 | A1 * | 1/2016 | Conrad | A47L 9/22 15/344 |
| 2016/0128530 | A1 | 5/2016 | Thorne et al. | |
| 2016/0174793 | A1 | 6/2016 | Burke et al. | |
| 2016/0220080 | A1 | 8/2016 | Thorne et al. | |
| 2016/0220081 | A1 | 8/2016 | Xu et al. | |
| 2016/0220082 | A1 | 8/2016 | Thorne et al. | |
| 2016/0324388 | A1 | 11/2016 | Vrdoljak et al. | |
| 2016/0374533 | A1 | 12/2016 | Innes et al. | |
| 2017/0042319 | A1 | 2/2017 | Conrad et al. | |
| 2017/0112343 | A1 | 4/2017 | Innes et al. | |
| 2017/0127896 | A1 | 5/2017 | Carter et al. | |
| 2017/0144810 | A1 | 5/2017 | Birdsell | |
| 2017/0215667 | A1 | 8/2017 | Thorne et al. | |
| 2017/0347848 | A1 | 12/2017 | Carter et al. | |
| 2018/0035854 | A1 | 2/2018 | Thorne et al. | |
| 2018/0064301 | A1 | 3/2018 | Cottrell et al. | |
| 2018/0068815 | A1 | 3/2018 | Cottrell | |
| 2018/0070785 | A1 | 3/2018 | Udy et al. | |
| 2018/0255991 | A1 | 9/2018 | Der Marderosian et al. | |
| 2018/0296046 | A1 | 10/2018 | Thorne et al. | |
| 2018/0306432 | A1 | 10/2018 | Ognjen et al. | |
| 2018/0325252 | A1 | 11/2018 | Hopke et al. | |
| 2018/0338654 | A1 | 11/2018 | Kelsey | |
| 2018/0338656 | A1 | 11/2018 | Carter et al. | |
| 2019/0038098 | A1 | 2/2019 | Thorne et al. | |
| 2019/0059668 | A1 | 2/2019 | Thorne et al. | |
| 2019/0069740 | A1 | 3/2019 | Thorne et al. | |
| 2019/0069744 | A1 | 3/2019 | Liggett et al. | |
| 2019/0090701 | A1 | 3/2019 | Tonderys et al. | |
| 2019/0090705 | A1 | 3/2019 | Thorne et al. | |
| 2019/0191947 | A1 | 6/2019 | Freese et al. | |
| 2019/0193120 | A1 | 6/2019 | Brown et al. | |
| 2019/0246853 | A1 | 8/2019 | Sardar et al. | |
| 2019/0274500 | A1 | 9/2019 | Thorne et al. | |
| 2019/0274501 | A1 | 9/2019 | Antonisami et al. | |
| 2019/0302793 | A1 | 10/2019 | Leech et al. | |
| 2019/0320865 | A1 | 10/2019 | Brown et al. | |
| 2019/0320866 | A1 | 10/2019 | Thorne et al. | |
| 2019/0335968 | A1 | 11/2019 | Harting et al. | |
| 2019/0343349 | A1 | 11/2019 | Clare et al. | |
| 2019/0357740 | A1 | 11/2019 | Thorne et al. | |
| 2020/0000298 | A1 | 1/2020 | Brown et al. | |
| 2020/0022543 | A1 | 1/2020 | Gill et al. | |
| 2020/0022544 | A1 | 1/2020 | Gill et al. | |
| 2020/0022553 | A1 | 1/2020 | Gill et al. | |
| 2020/0037833 | A1 | 2/2020 | Niedzwecki et al. | |
| 2020/0037843 | A1 | 2/2020 | Fiebig et al. | |
| 2020/0046184 | A1 | 2/2020 | Freese et al. | |
| 2020/0077855 | A1 | 3/2020 | Brown et al. | |
| 2020/0085267 | A1 | 3/2020 | Thorne et al. | |
| 2020/0085269 | A1 | 3/2020 | Thorne | |
| 2020/0121144 | A1 | 4/2020 | Gacin et al. | |
| 2020/0121148 | A1 | 4/2020 | Hoffman et al. | |
| 2020/0138260 | A1 | 5/2020 | Sutter et al. | |
| 2020/0166949 | A1 | 5/2020 | Leech et al. | |
| 2020/0170470 | A1 | 6/2020 | Liggett et al. | |
| 2020/0201348 | A1 | 6/2020 | Leech | |
| 2020/0205631 | A1 | 7/2020 | Brown et al. | |
| 2020/0205634 | A1 | 7/2020 | Sutter et al. | |
| 2020/0237171 | A1 | 7/2020 | Xu et al. | |
| 2020/0288929 | A1 | 9/2020 | Brunner et al. | |
| 2020/0288930 | A1 | 9/2020 | Wells | |
| 2020/0297172 | A1 | 9/2020 | Tonderys et al. | |
| 2020/0301430 | A1 | 9/2020 | Irkliy et al. | |
| 2020/0315418 | A1 | 10/2020 | Howard et al. | |
| 2020/0345196 | A1 | 11/2020 | Innes et al. | |
| 2020/0367711 | A1 | 11/2020 | Thorne et al. | |
| 2020/0371526 | A1 | 11/2020 | Kamada | |
| 2020/0383547 | A1 | 12/2020 | Sutter et al. | |
| 2021/0007569 | A1 | 1/2021 | Howard et al. | |
| 2021/0022574 | A1 | 1/2021 | Harting | |
| 2021/0030227 | A1 | 2/2021 | Mathieu et al. | |
| 2021/0038032 | A1 | 2/2021 | Brown | |
| 2021/0059495 | A1 | 3/2021 | Gill et al. | |
| 2021/0085144 | A1 | 3/2021 | Woodrow et al. | |
| 2021/0169289 | A1 | 6/2021 | Thorne et al. | |
| 2021/0175772 | A1 | 6/2021 | Aini | |
| 2021/0177223 | A1 | 6/2021 | Der Marderosian et al. | |
| 2021/0186282 | A1 | 6/2021 | Mathieu et al. | |
| 2021/0204684 | A1 | 7/2021 | Heman-Ackah et al. | |
| 2021/0254615 | A1 | 8/2021 | Vrdoljak et al. | |
| 2021/0307581 | A1 | 10/2021 | Thorne et al. | |
| 2021/0315428 | A1 | 10/2021 | Udy et al. | |
| 2021/0345848 | A1 * | 11/2021 | Jeon | A47L 9/0063 |
| 2021/0386261 | A1 | 12/2021 | Woodrow et al. | |
| 2021/0386262 | A1 | 12/2021 | Uchendu et al. | |
| 2022/0031131 | A1 | 2/2022 | Mcclay et al. | |
| 2022/0031133 | A1 | 2/2022 | Der Marderosian et al. | |
| 2022/0031134 | A1 | 2/2022 | Yang et al. | |
| 2022/0061614 | A1 | 3/2022 | Yu et al. | |
| 2022/0071459 | A1 | 3/2022 | Gacin et al. | |
| 2022/0095864 | A1 | 3/2022 | Der Marderosian et al. | |
| 2022/0125256 | A1 | 4/2022 | Lessard et al. | |
| 2022/0287521 | A1 | 9/2022 | Cottrell et al. | |
| 2022/0322903 | A1 | 10/2022 | Lessard | |
| 2022/0322904 | A1 | 10/2022 | Conrad | |
| 2022/0400922 | A1 | 12/2022 | Mcclay et al. | |
| 2022/0408994 | A1 | 12/2022 | Hill | |
| 2023/0043567 | A1 | 2/2023 | Copeland et al. | |
| 2023/0070147 | A1 | 3/2023 | Harting et al. | |
| 2023/0157495 | A1 | 5/2023 | Copeland et al. | |
| 2023/0248192 | A1 | 8/2023 | Brown et al. | |
| 2023/0329502 | A1 | 10/2023 | Chirikjian et al. | |
| 2024/0415352 | A1 | 12/2024 | Mcclay et al. | |

FOREIGN PATENT DOCUMENTS

| | | | | |
|---|---|---|---|---|
| CN | 110141156 A * | 8/2019 | | A47L 9/244 |
| CN | 209826545 | 12/2019 | | |
| EP | 3412185 | 12/2018 | | |
| JP | 2016123746 | 7/2016 | | |
| JP | 2016137164 | 8/2016 | | |
| JP | 2018015422 | 2/2018 | | |
| JP | 2019098029 | 6/2019 | | |
| JP | 2020110472 A * | 7/2020 | | A47L 5/22 |
| JP | 2020523117 | 8/2020 | | |
| KR | 20090069653 A * | 7/2009 | | A47L 5/225 |
| KR | 102061513 | 1/2020 | | |
| WO | 2019038446 | 2/2019 | | |
| WO | WO-2019060564 A1 * | 3/2019 | | A47L 5/24 |
| WO | 2019157168 A1 | 8/2019 | | |
| WO | 2019188028 | 10/2019 | | |

OTHER PUBLICATIONS

Espacenet Translation JP 2020110472 Description; Vacuum Cleaner; Yamatani, H; Ito, N; Jul. 27, 2020 (Year: 2020).*

KR-20090069653 PE2E Translation; Vacuum Cleaner; Park Seong Ho; Jul. 1, 2009 (Year: 2009).*

WO-2019060564 PE2E Translation; Tonderys Daniel; Hand-Held Surface Cleaning Device; Mar. 28, 2019 (Year: 2019).*

(56) References Cited

OTHER PUBLICATIONS

PCT Search Report and Written Opinion mailed Nov. 4, 2021, received in corresponding PCT Application No. PCT/US21/43740, 12 pages.
Japanese Office Action with machine-generated English translation dated Dec. 26, 2023, received in Japanese Patent Application No. 2023-506279, 8 pages.
Japanese Office Action issued Aug. 27, 2024, received in Japanese Patent Application No. 2023-506279, 6 pages.
Extended European Search Report issued Nov. 25, 2024, received in European Patent Application No. 21851441.2, 9 pages.
Chinese Office Action with machine-generated English translation issued Jun. 30, 2025 received in Chinese Patent Application No. 202180058209.1, 17 pages.
Chinese Office Action with machine-generated English translation issued Mar. 4, 2026, received in Chinese Patent Application No. 202180058209.1, 7 pages.
Japanese Notice of Reasons for Refusal with machine-generated English translation issued May 12, 2026, received in Japanese Patent Application No. 2025-061076, 10 pages.

* cited by examiner

SURFACE CLEANING APPARATUS

CROSS-REFERENCE TO RELATED APPLICATIONS

The present application claims the benefit of U.S. Provisional Application Ser. No. 63/058,397 filed on Jul. 29, 2020, entitled Surface Cleaning Apparatus and U.S. Provisional Application Ser. No. 63/209,701 filed on Jun. 11, 2021, entitled Surface Cleaning Apparatus, each of which are fully incorporated herein by reference.

TECHNICAL FIELD

The present disclosure is generally related to surface cleaning apparatuses and more specifically related to vacuum cleaners.

BACKGROUND INFORMATION

Surface cleaning apparatuses can include vacuum cleaners. Vacuum cleaners may include a suction motor, a dust cup, and an inlet. The suction motor is fluidly coupled to the dust cup and the inlet such that air can flow from the inlet into the dust cup and through the suction motor. Air flowing into the dust cup may have debris entrained therein. At least a portion of the entrained debris may fall out of entrainment when passing through the dust cup.

One example of a vacuum cleaner may be an upright vacuum cleaner. An upright vacuum cleaner may include a surface cleaning head and an upright section, wherein the upright section is pivotally coupled to the surface cleaning head. The upright section is configured to pivot between a storage position and an in-use position. Another example of a vacuum cleaner may be a handheld vacuum cleaner that is configured to be supported in the hand of a user independently from a surface to be cleaned. As such, a handheld vacuum cleaner may be more maneuverable when compared to an upright vacuum cleaner.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a surface cleaning apparatus. The surface cleaning apparatus may include a cleaner body, a suction motor, and a dust cup. The cleaner body has a handle end and a body attachment end. The body attachment end is opposite the handle end along a body longitudinal axis. The body attachment end includes a cleaner inlet that is fluidly coupled to the suction motor and dust cup such that the suction motor can cause air to be drawn through the cleaner inlet and into the dust cup. The body attachment end further includes a body latch configured to be actuated between a retaining position and a releasing position in response to actuation of a body toggle. When in the retaining position, the body latch is configured to couple a cleaning accessory to the body attachment end and, when in the releasing position, the body latch is configured to allow the cleaning accessory to be removed from the body attachment end.

One example of a cleaning accessory is a wand. The wand includes a wand body having a coupling end configured to releasably couple to the body attachment end of the surface cleaning apparatus and a wand attachment end configured to releasably couple to an additional cleaning accessory. The coupling end is opposite the wand attachment end along a wand longitudinal axis, wherein an air channel extends between the wand attachment end and the coupling end. The air channel is fluidly coupled to the body inlet, the suction motor, and the dust cup. The wand attachment end includes a wand latch configured to be actuated between a retaining position and a releasing position in response to actuation of a wand toggle. When in the retaining position, the wand latch is configured to couple a cleaning accessory to the wand attachment end and, when in the releasing position, the wand latch is configured to allow the cleaning accessory to be removed from the wand attachment end.

Figure 1:
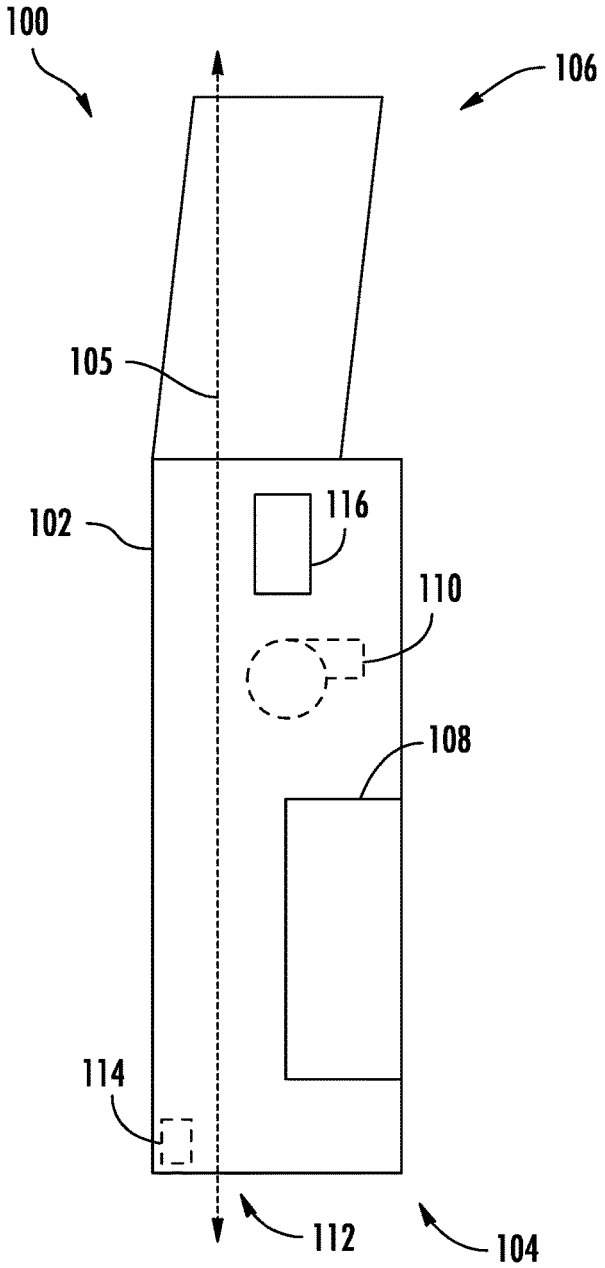
FIG. 1 is a schematic side view of a surface cleaning apparatus, consistent with embodiments of the present disclosure.

FIG. 1 shows a schematic example of a surface cleaning apparatus 100. As shown, the surface cleaning apparatus 100 includes a cleaner body 102 having a body attachment end 104 and a handle end 106, a dust cup 108 coupled (e.g., pivotally and/or removably coupled) to the cleaner body 102, and a suction motor 110 (shown in hidden lines) disposed within the cleaner body 102. The handle end 106 is opposite the body attachment end 104 along a longitudinal axis 105 of the cleaner body 102. The cleaner body 102 may have a generally elongate shape. For example, at least a portion of the elongate shape may include a generally tubular shape (e.g., a generally tubular shape may include one or more planar surfaces). The dust cup 108 and the suction motor 110 can be disposed between the handle end 106 and the body attachment end 104. In some instances, the suction motor 110 may be disposed (e.g., along the longitudinal axis 105) between the handle end 106 and the dust cup 108.

The body attachment end 104 includes a cleaner inlet 112 that is fluidly coupled to the dust cup 108 and the suction motor 110 such that the suction motor 110 can cause air to be drawn into the cleaner inlet 112 and through the dust cup 108 and suction motor 110. Air drawn into the cleaner inlet 112 may have debris entrained therein. At least a portion of the debris entrained within the air may be deposited within the dust cup 108.

The body attachment end 104 can be configured to removably couple to a cleaning accessory. For example, the body attachment end 104 may include a body latch 114 (shown in hidden lines) configured to releasably engage a cleaning accessory. The body latch 114 is configured to transition between a retaining position and a releasing position in response to actuation of a body toggle 116. The body toggle 116 can be mechanically connected to the body latch 114 (e.g., using a pull-rod or pushrod) such that a movement of the body toggle 116 causes the body latch 114 to be actuated.

The body toggle 116 is disposed between the handle end 106 and the body attachment end 104. For example, the body toggle 116 can be disposed at a position between the dust cup 108 and the handle end 106. By way of further example, the body toggle 116 can be disposed at a position between the suction motor 110 and the handle end 106. By way of still further example, the body toggle 116 may be disposed proximate to the suction motor 110 (e.g., within a distance measuring less than a largest dimension of the body toggle 116).

Figure 2:
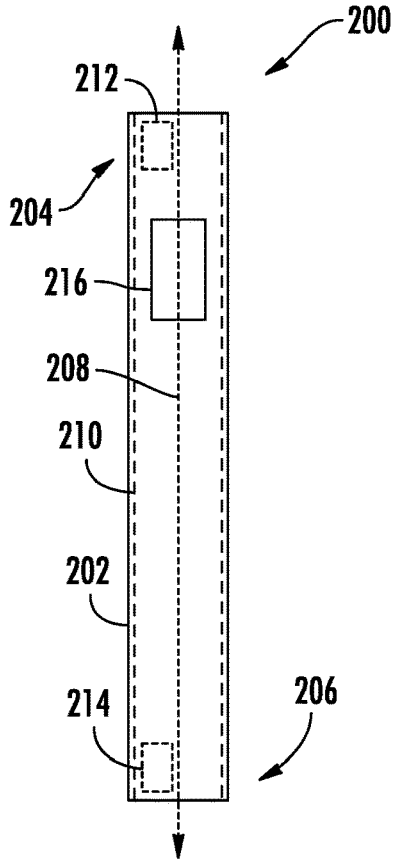
FIG. 2 is a schematic side view of a wand configured to be fluidly coupled to the surface cleaning apparatus of FIG. 1, consistent with embodiments of the present disclosure.

FIG. 2 shows a schematic example of a wand 200. The wand 200 may be an example of a cleaning accessory configured to couple to the body attachment end 104 of the cleaner body 102 of the surface cleaning apparatus 100 of FIG. 1. As shown, the wand 200 includes a wand body 202 having a wand attachment end 204 and a coupling end 206, the wand attachment end 204 being opposite the coupling end 206 along a wand longitudinal axis 208. An air channel 210 (shown in hidden lines) extends from the wand attachment end 204 to the coupling end 206. The air channel 210 is configured to be fluidly coupled to the dust cup 108 and the suction motor 110 such that the suction motor 110 can cause air to be drawn through the air channel 210.

The coupling end 206 is configured to couple to the surface cleaning apparatus 100 at the body attachment end 104. For example, the wand attachment end 204 may include a wand catch 212 configured to engage the body latch 114 of the surface cleaning apparatus 100 when the body latch 114 is in the retaining position. As such, the wand catch 212 and the body latch 114 may generally be described as being configured to cooperate to removably couple the wand 200 to the surface cleaning apparatus 100.

The wand attachment end 204 is configured to removably couple to an additional cleaning accessory such as, for example, a surface cleaning head having one or more agitators (e.g., one or more brush rolls). For example, the wand attachment end 204 may include a wand latch 214 configured to be transitioned between a retaining position and a releasing position in response to actuation of a wand toggle 216. The wand toggle 216 can be mechanically connected to the wand latch 214 (e.g., using a pull-rod or pushrod) such that a movement of the wand toggle 216 causes the wand latch 214 to be actuated.

Figure 3:
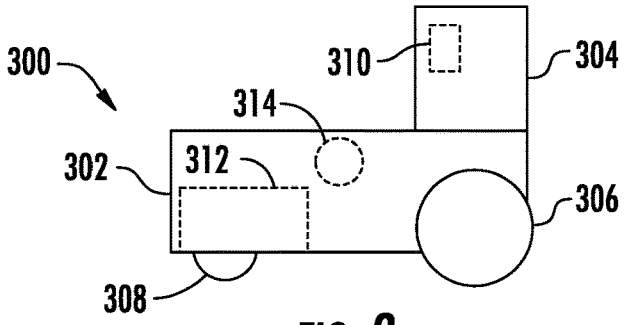
FIG. 3 is a schematic side view of a surface cleaning head configured to be fluidly coupled to the surface cleaning apparatus of FIG. 1, consistent with embodiments of the present disclosure.

FIG. 3 shows a schematic example of a surface cleaning head 300. As shown, the surface cleaning head 300 includes a head body 302, a connector 304 pivotally coupled to the head body 302, at least one wheel 306 rotatably coupled to the head body 302, and at least one agitator 308 (e.g., brush roll) rotatably coupled to the head body 302. The connector 304 is configured to removably couple to, for example, the wand attachment end 204 and/or the body attachment end 104. For example, the connector 304 may include a connector catch 310 (shown in hidden lines) configured to cooperate with one or more of the wand latch 214 and/or the body latch 114.

The connector 304 may be further configured to fluidly couple an agitator chamber 312 (shown in hidden lines) of the surface cleaning head 300 to the suction motor 110. For example, the connector 304 may be configured to fluidly couple the agitator chamber 312 to the air channel 210 of the wand 200. As such, the agitator chamber 312 may generally be described as being configured to be fluidly coupled to the dust cup 108 and the suction motor 110 via the wand 200. The agitator chamber 312 includes the at least one agitator 308. In operation, the suction motor 110 causes air to be drawn into the agitator chamber 312 and the agitator 308 is caused to rotate. Rotation of the agitator 308 causes at least a portion of debris on a surface to be cleaned to be dislodged therefrom such that at least a portion of the dislodged debris becomes entrained within air flowing through the agitator chamber 312.

The at least one agitator 308 may be coupled to a drive motor 314 such that the drive motor 314 causes the at least one agitator 308 to rotate. The drive motor 314 may be powered by, for example, one or more batteries (e.g., one or more batteries of the surface cleaning head 300 and/or of the surface cleaning apparatus 100). In some instances, the wand 200 may be further configured to electrically couple the surface cleaning apparatus 100 to the surface cleaning head 300. As such, one or more batteries of the surface cleaning apparatus 100 may power the drive motor 314.

Figure 4:
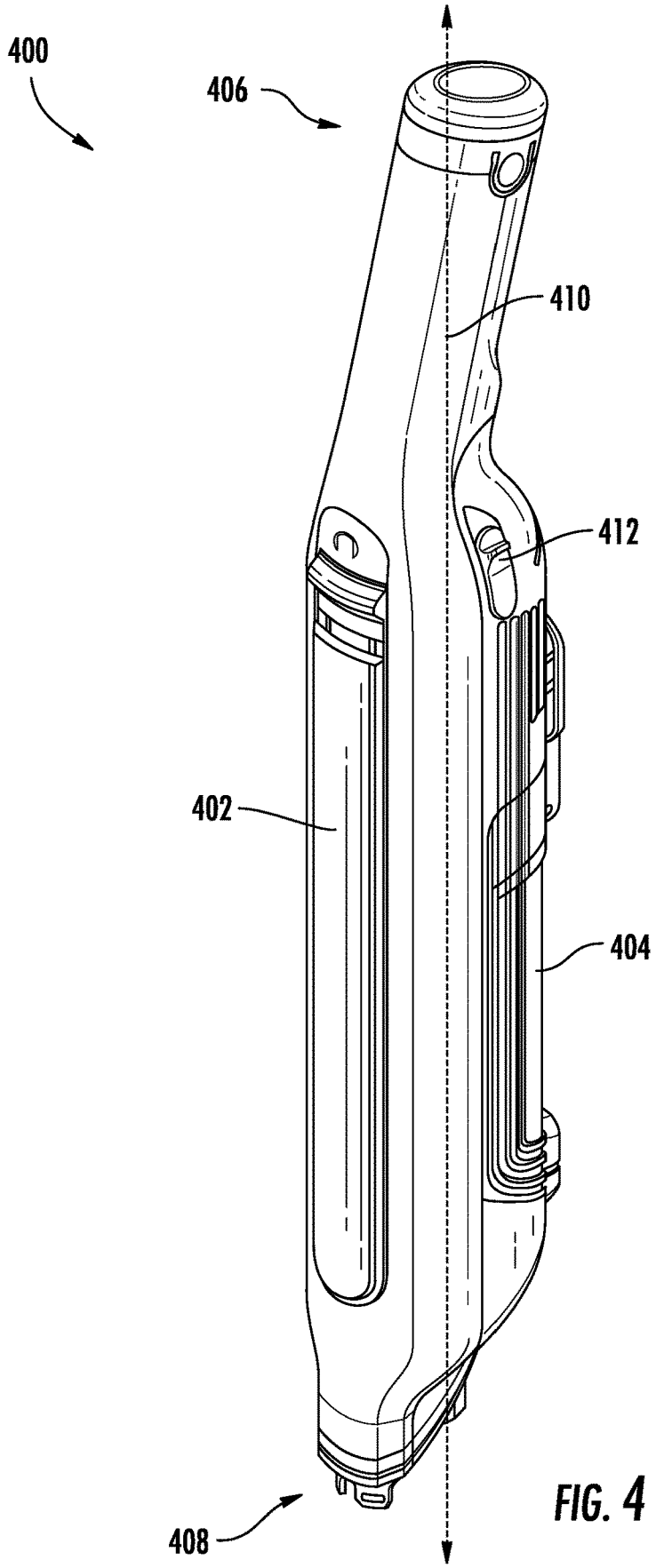
FIG. 4 is a perspective view of a vacuum cleaner, consistent with embodiments of the present disclosure.

FIG. 4 shows a perspective view of a vacuum cleaner 400, which may be an example of the surface cleaning apparatus 100 of FIG. 1. As shown, the vacuum cleaner 400 includes a cleaner body 402 and a dust cup 404 coupled (e.g., removably and/or pivotally) to the cleaner body 402. The cleaner body 402 includes a handle end 406 and a body attachment end 408, the handle end 406 being opposite the body attachment end 408 along a body longitudinal axis 410.

The body attachment end 408 is configured to removably couple to a cleaning accessory (e.g., the wand 200 or surface cleaning head 300 of FIGS. 2 and 3). For example, the vacuum cleaner 400 may include at least one body toggle 412 configured to be actuated between a retaining and a releasing position. When the body toggle 412 is in the retaining position, the cleaning accessory may be coupled to the cleaner body 402. When the body toggle 412 is in the releasing position, the cleaning accessory may be removed from the cleaner body 402.

As shown, the body toggle 412 is positioned between the handle end 406 and the body attachment end 408. For example, the body toggle 412 may be positioned along the cleaner body 402 at a position that is closer to the handle end 406 than to the body attachment end 408. In some instances, the body toggle 412 may be positioned between the dust cup 404 and the handle end 406.

As shown, the body toggle 412 is configured to slide when actuated. For example, the body toggle 412 can be configured to slide in a direction substantially (e.g., within 1°, 2°, 3°, 4°, or 5° of) parallel to the body longitudinal axis 410. In some instances, there may be a plurality of body toggles 412, wherein the body toggles 412 are disposed on opposing sides of the cleaner body 402. For example, both body toggles 412 may be actuated together when transitioning between retaining and releasing positions.

Figure 5:
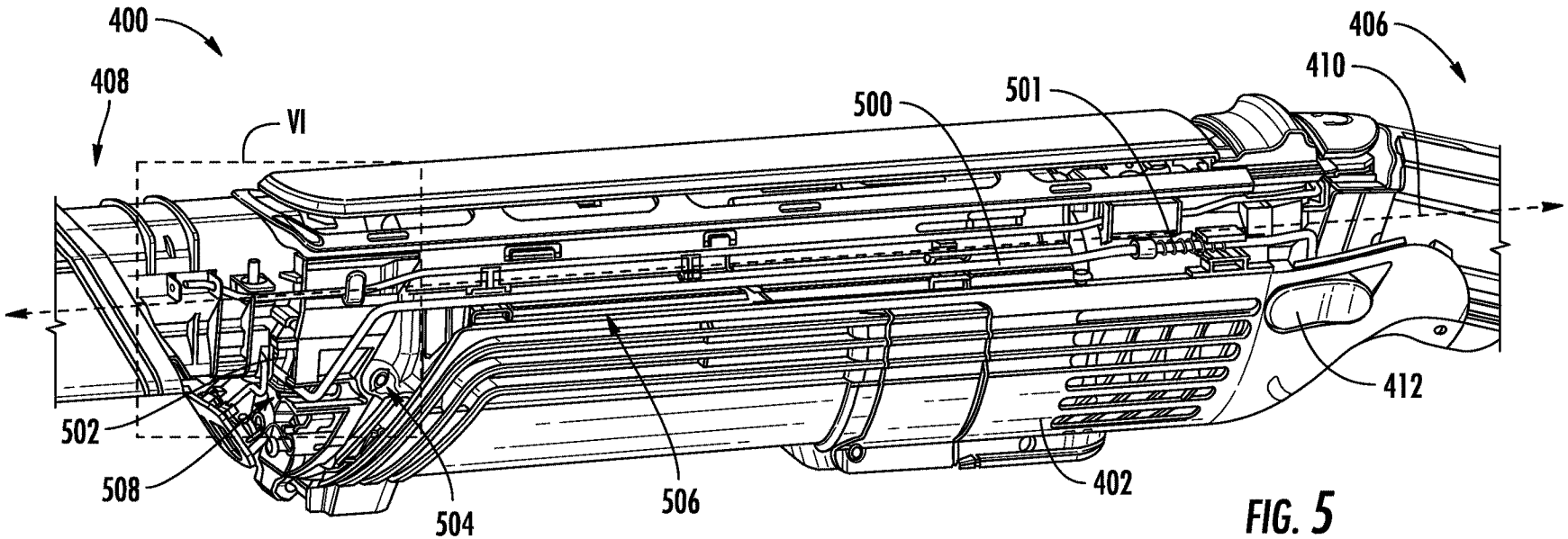
FIG. 5 is a perspective view of the vacuum cleaner of FIG. 4, wherein a portion of a body of the vacuum cleaner has been removed therefrom for purposes of clarity, consistent with embodiments of the present disclosure.

FIG. 5 shows a perspective view of the vacuum cleaner 400 of FIG. 4, wherein a portion of the cleaner body 402 has been removed therefrom for purposes of clarity. The body toggle 412 can engages with (e.g., is coupled to) a body pull-rod 500. As shown, actuation of the body toggle 412 causes the body pull-rod 500 to transition between a retaining position and a releasing position. The body pull-rod 500 is configured to engage (e.g., be coupled to) a body latch 502. Movement of the body pull-rod 500 causes the body latch 502 to transition between a retaining position and a releasing position. For example, the body pull-rod 500 may be configured to urge the body latch 502 to transition from the retaining position and towards the releasing position. When the body latch 502 is in the retaining position, the cleaning accessory can be coupled to the body attachment end 408. When the body latch 502 is in the releasing position, the cleaning accessory can be removed from the body attachment end 408.

As shown, the body latch 502 is positioned between the handle end 406 and the body attachment end 408. For example, the body latch 502 may be positioned closer to the body attachment end 408 than the handle end 406. In this example, the body toggle 412 is longitudinally spaced apart from the body latch 502. In some instances, and as shown, the body toggle 412 may also be vertically spaced apart from the body latch 502 and/or horizontally spaced apart from the body latch 502 in a direction transverse (e.g., perpendicular) to the body longitudinal axis 410.

When the body toggle 412 is longitudinally and vertically spaced apart from the body latch 502, the body pull-rod 500 may have a non-linear shape. For example, the body pull-rod 500 may include one or more vertical extension regions 504 and one or more longitudinal extension regions 506. When the body toggle 412 is horizontally spaced apart from the body latch 502 in a direction transverse (e.g., perpendicular) to the body longitudinal axis 410, the body pull-rod 500 may include an engagement region 508. The engagement region 508 may extend transverse to the vertical and longitudinal extension regions 504 and 506. In some instances, the vacuum cleaner 400 may include a plurality of body toggles 412 disposed on opposing sides of the cleaner body 402, wherein the body pull-rod 500 is coupled to both body toggles 412. In some instances, a pull-rod biasing mechanism 501 may extend around a portion of the body pull-rod 500 and urge the body pull-rod 500 towards the retaining position. For example, the pull-rod biasing mechanism 501 may be a compression spring that is configured to extend along a portion of the longitudinal extension region 506.

Figure 6:
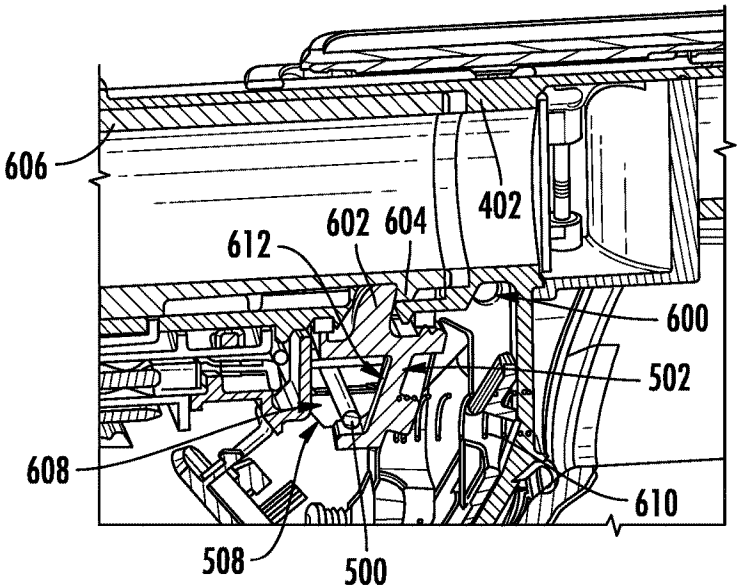
FIG. 6 is a magnified cross-sectional view corresponding to region VI of FIG. 5, consistent with embodiments of the present disclosure.

FIG. 6 shows a magnified cross-sectional view corresponding to region VI of FIG. 5. As shown, the body latch 502 is pivotally coupled to the cleaner body 402 at a pivot point 600. The body latch 502 includes a paw 602 configured to engage with an accessory catch 604 of a cleaning accessory 606 and a receptacle 608 configured to receive the body pull-rod 500. The paw 602 is configured to pivot out of engagement (e.g., contact) with the accessory catch 604 in response to movement of the body pull-rod 500. A biasing mechanism 610 (e.g., a spring) may be configured to urge the body latch 502 to pivot such that the paw 602 is urged into engagement with the accessory catch 604. When the paw 602 is engaging the accessory catch 604, the body latch 502 is in the retaining position and, when the paw 602 is out of engagement with the accessory catch 604, the body latch 502 is in the releasing position.

The receptacle 608 may be at least partially defined by a ramped surface 612. For example, and as shown, the ramped surface 612 may be configured such that a depth of the receptacle 608 decreases with increasing distance from the paw 602. When the body pull-rod 500 transitions between the retaining and releasing positions, the engagement region 508 of the body pull-rod 500 may slide along the ramped surface 612.

Figure 28:
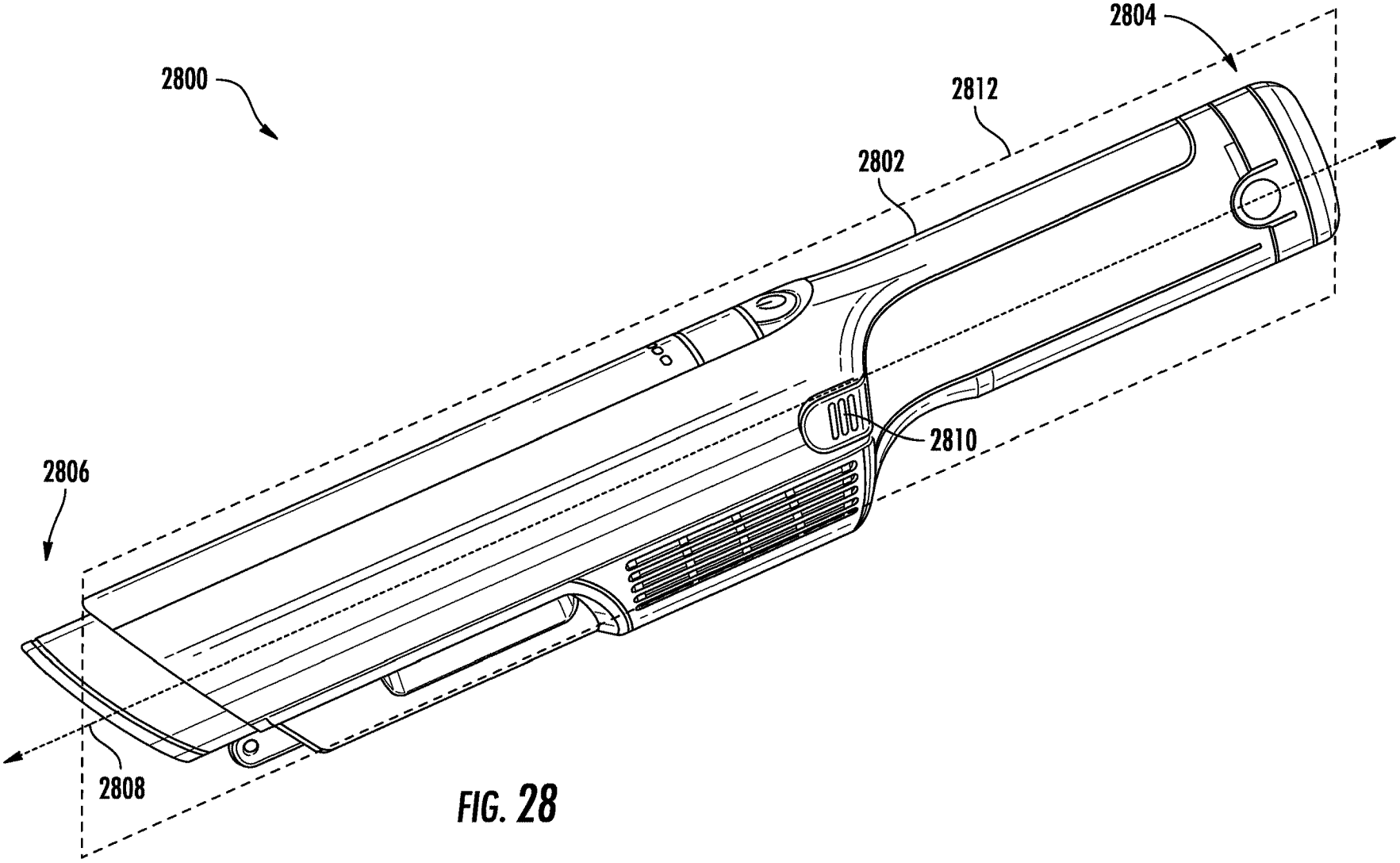
FIG. 28 shows a perspective view of a vacuum cleaner, consistent with embodiments of the present disclosure.
Figure 29:
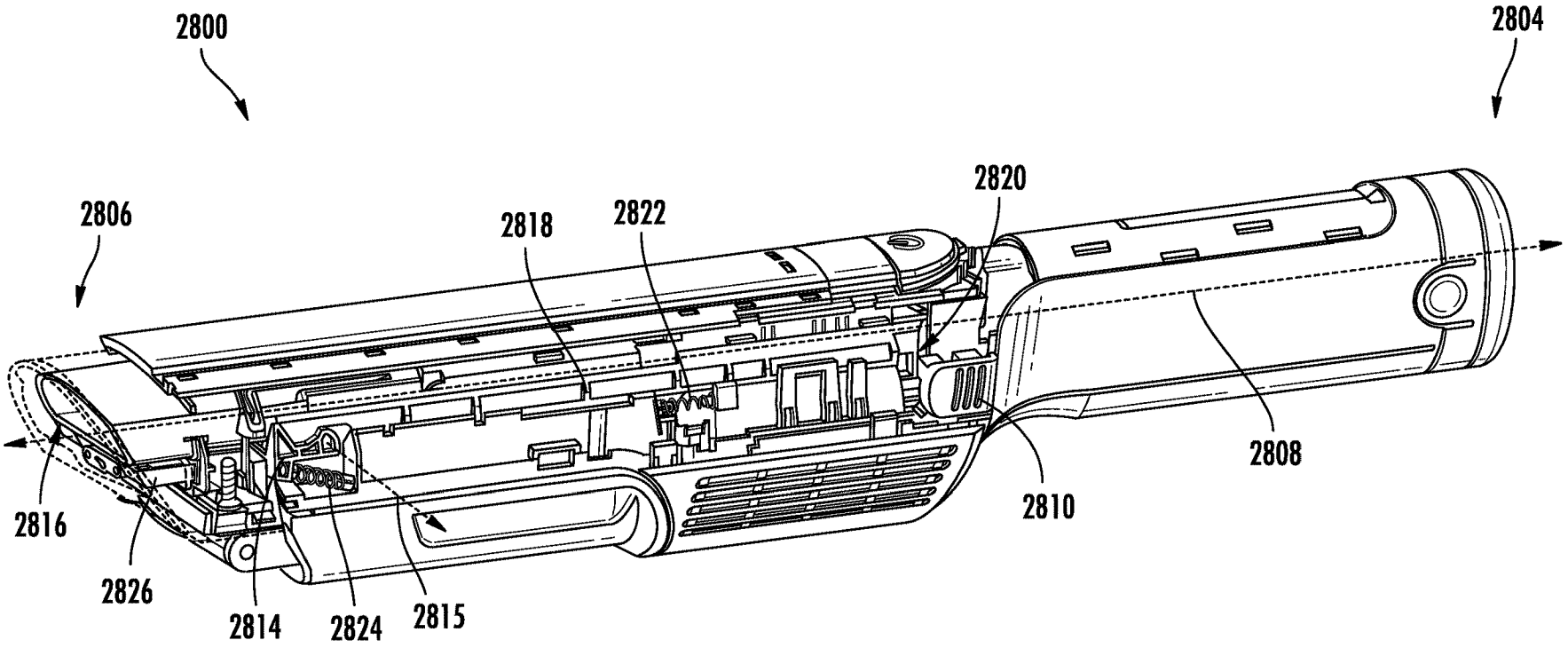
FIG. 29 shows a perspective view of the vacuum cleaner of FIG. 28 have a portion of the body removed therefrom, consistent with embodiments of the present disclosure.
Figure 30:
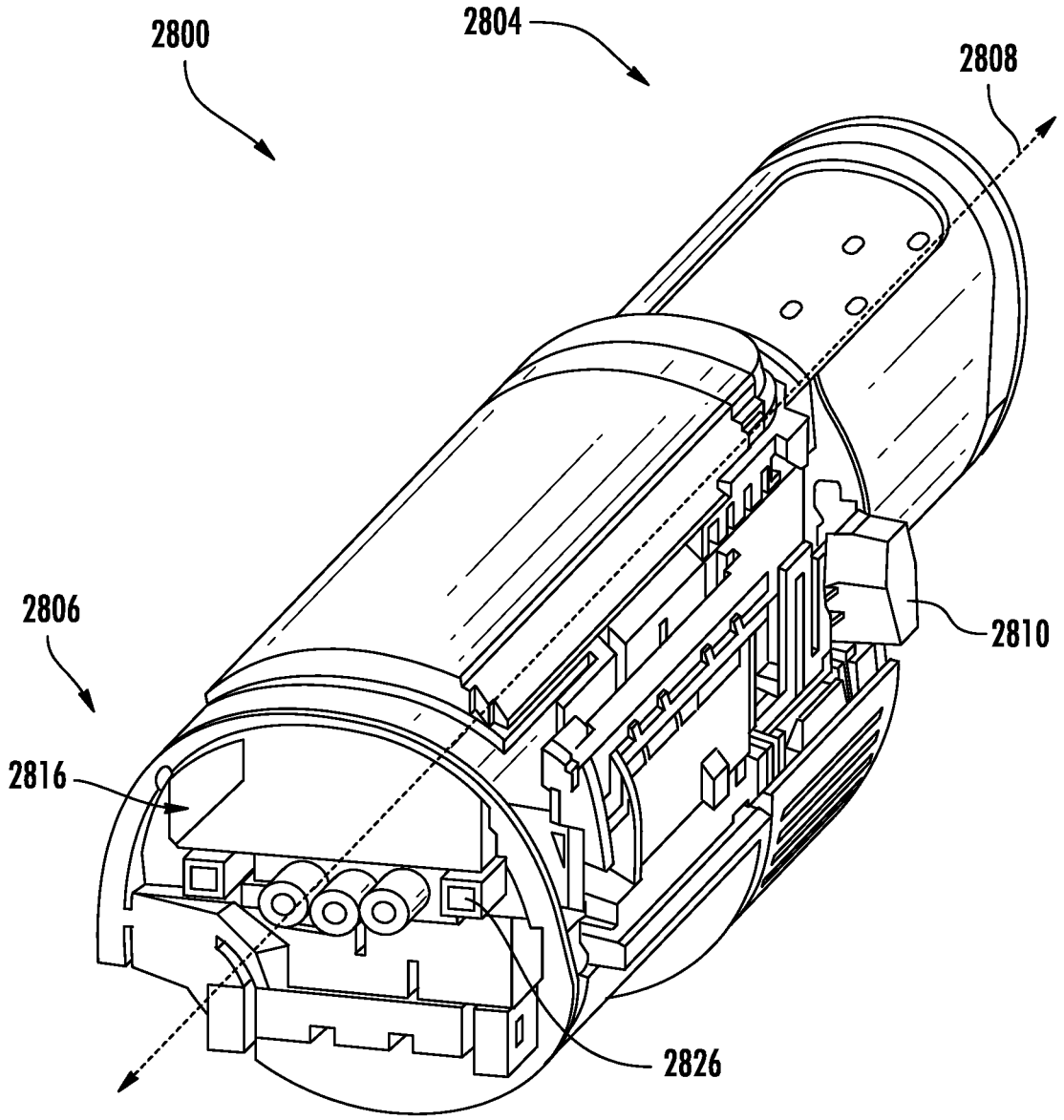
FIG. 30 shows an end perspective view of the vacuum cleaner of FIG. 29, consistent with embodiments of the present disclosure.

FIG. 28 shows an example of a vacuum cleaner 2800, which may be an example of the surface cleaning apparatus 100 of FIG. 1, and FIGS. 29 and 30 show an example of the vacuum cleaner 2800 having a portion of a cleaner body 2802 removed therefrom for purposes of clarity. As shown, the vacuum cleaner 2800 includes a handle end 2804 and a body attachment end 2806, the body attachment end 2806 being opposite the handle end 2804 along a longitudinal axis 2808 of the vacuum cleaner 2800. A body toggle 2810 is disposed between the handle end 2804 and the body attachment end 2806. The body toggle 2810 can be positioned closer to the handle end 2804 than the body attachment end 2806. In some instances, there may be a plurality of body toggles 2810, each body toggle 2810 being on an opposite side of the vacuum cleaner 2800. The body toggle 2810 is configured to transition between a retaining position and a releasing position. For example, the body toggle 2810 may be configured to be depressed inwardly towards a central longitudinal plane 2812 of the vacuum cleaner 2800. In this example, when there are a plurality of body toggles 2810 each body toggle 2810 may move inwardly towards each other.

The body attachment end 2806 is configured to removably couple to one or more cleaning accessories (e.g., the wand 200 or surface cleaning head 300 of FIGS. 2 and 3). For example, a body latch 2814 can be configured to removably couple a cleaning accessory to the body attachment end 2806. As shown, the body latch 2814 can be disposed proximate the body attachment end 2806. For example, at least a portion of the body latch 2814 may be disposed within a suction inlet 2816 of the vacuum cleaner 2800. The body latch 2814 is moveably coupled to the cleaner body 2802 such that the body latch 2814 transitions between a retaining position and a releasing position in response to the actuation of the body toggle 2810.

As shown, the body toggle 2810 engages (e.g., is coupled to) a pushrod 2818. Actuation of the body toggle 2810 causes the pushrod 2818 to be urged in a direction substantially parallel to the longitudinal axis 2808 of the vacuum cleaner 2800. When actuating the body toggle 2810, the body toggle 2810 moves in a direction transverse to (e.g., substantially perpendicular to) the movement of the pushrod 2818.

The body toggle 2810 can be configured to engage (e.g., contact) an angled surface 2820 of the pushrod 2818, wherein engagement between the body toggle 2810 and the angled surface 2820 causes the pushrod 2818 to move longitudinally in a direction of the body attachment end 2806. Movement of the pushrod 2818 towards the body attachment end 2806 urges the body latch 2814 towards the releasing position. For example, the body latch 2814 may be pivotally coupled to the cleaner body 2802 such that the body latch 2814 pivots about a latch pivot axis 2815 that extends transverse to (e.g., perpendicular to) the longitudinal axis 2808. The body latch 2814 pivots towards the releasing position in response to the longitudinal movement of the pushrod 2818. The pushrod 2818 may be biased (e.g., using a pushrod biasing mechanism 2822 such as a spring) in a direction of the handle end 2804 and the body latch 2814 may be biased (e.g., using a latch biasing mechanism 2824 such as a spring) towards the latching position.

In some instances, the vacuum cleaner 2800 may include one or more biased accessory plungers 2826. The one or more biased accessory plungers 2826 are configured to urge an accessory coupled at the body attachment end 2806 in a direction away from the handle end 2804. As such, when the body latch 2814 transitions to the releasing position, the one or more biased accessory plungers 2826 may cause the accessory to move in a direction substantially parallel to the longitudinal axis 2808. Movement of the accessory longitudinally may prevent the body latch 2814 from re-engaging with the accessory when the body latch 2814 transitions back towards the latching position. Such a configuration may encourage easier removal of an accessory.

Figure 7:
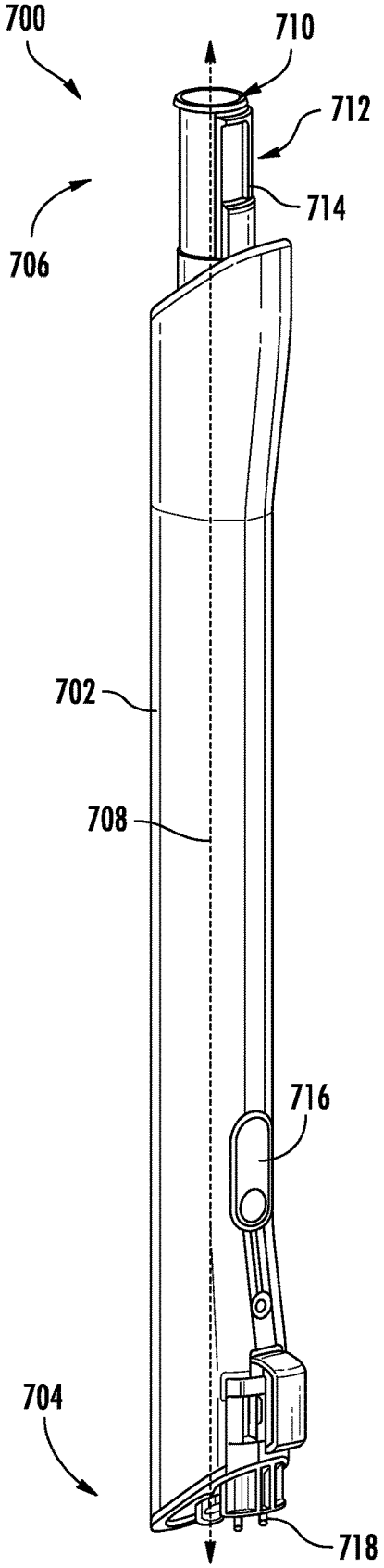
FIG. 7 is a perspective view of a wand configured to be fluidly coupled to the vacuum cleaner of FIG. 4, consistent with embodiments of the present disclosure.

FIG. 7 shows a perspective view of a wand 700, which may be an example of the wand 200 of FIG. 2. The wand 700 is one example of a cleaning accessory. As shown, the wand 700 includes a wand body 702 having a wand attachment end 704 and a coupling end 706, the wand attachment end 704 being opposite the coupling end 706 along a wand longitudinal axis 708. An air channel 710 is defined within the wand body 702. The air channel 710 extends from the wand attachment end 704 to the coupling end 706 and is configured to fluidly couple to, for example, the dust cup 404 of the vacuum cleaner 400.

The coupling end 706 is configured to couple to the vacuum cleaner 400 at the body attachment end 408. For example, the wand 700 can include a wand catch 712 configured to engage with the body latch 502 when the body latch 502 is in the retaining position. As shown, the wand catch 712 can define a recessed track 714 that extends (e.g., longitudinally) along an outer surface of the wand body 702, wherein the recessed track 714 has enclosed ends. As such, the wand catch 712 and the body latch 502 may generally be described as cooperating to removably couple the wand 700 to the vacuum cleaner 400.

The wand attachment end 704 is configured to removably couple to an additional cleaning accessory such as, for example, a surface cleaning head having one or more agitators (e.g., one or more brush rolls). For example, the wand attachment end 704 may include a wand latch configured to be transitioned between a retaining position and a releasing position in response to actuation of a wand toggle 716. The wand toggle 716 can be mechanically connected to the wand latch (e.g., using a pull-rod or pushrod) such that a movement of the wand toggle 716 causes the wand latch to be actuated.

Figure 8:
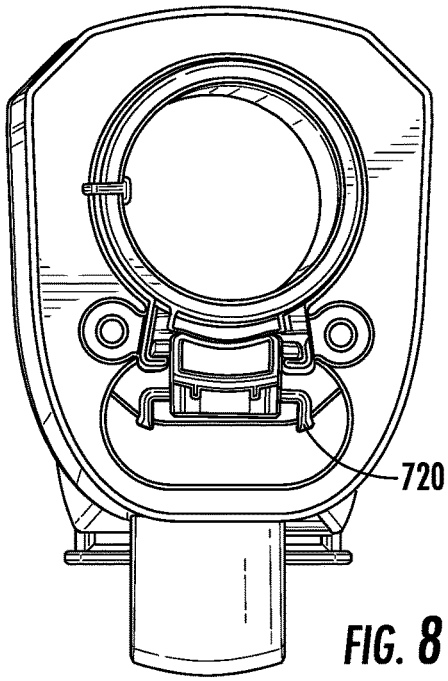
FIG. 8 is a perspective end view of the wand of FIG. 7, consistent with embodiments of the present disclosure.
Figure 8A:
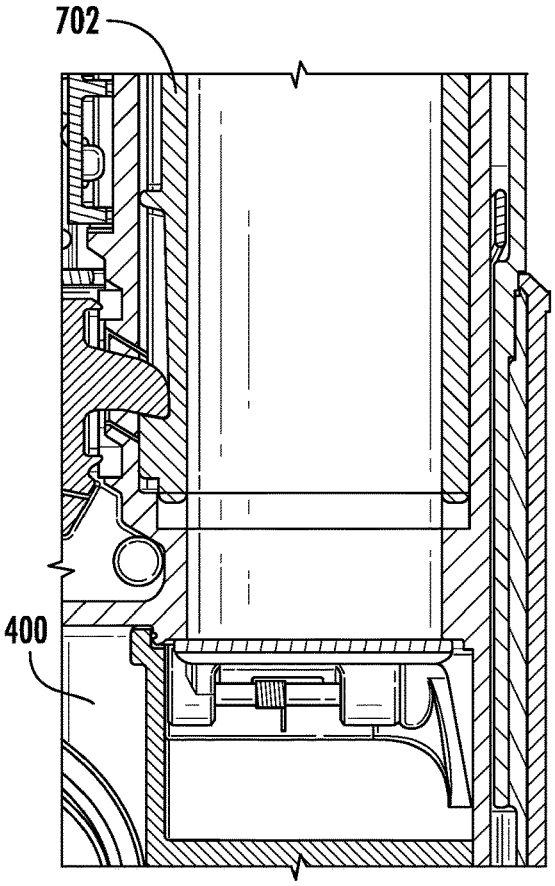
FIG. 8A is a cross-sectional view of a portion of the vacuum cleaner of FIG. 4 and of a portion of the wand of FIG. 7, wherein a portion of the wand is received within the vacuum cleaner, consistent with embodiments of the present disclosure.

As shown, the coupling end 706 and the wand attachment end 704 may have different sizes. For example, a widest width of the wand body 702 at the coupling end 706 may measure less than the widest width of the wand body 702 at the wand attachment end 704. Such a configuration may allow at least a portion of the wand body 702 to be received within the vacuum cleaner 400 when being coupled to the vacuum cleaner 400 (see, e.g., FIG. 8A). When at least a portion of the wand body 702 is received within the vacuum cleaner 400, the rigidity of the resulting assembly of the wand 700 and vacuum cleaner 400 may be increased. For example, a measure of a length of the wand body 702 received within the vacuum cleaner 400 may measure about (e.g., within 5%, 10%, 15%, 20%, or 25% of) two times a maximum width of the wand body 702 as measured at the coupling end 706. By way of further example, a measure of a length of the wand body 702 received within the vacuum cleaner 400 may measure within a range of 1.5 times to 2.5 times a maximum width of the wand body 702 as measured at the coupling end 706. By way of still further example, a measure of a length of the wand body 702 received within the vacuum cleaner 400 may measure 1.77 times a maximum width of the wand body 702 as measured at the coupling end 706.

As also shown, the wand 700 may further include accessory electrical connectors 718. The accessory electrical connectors 718 may be configured to be electrically coupled to cleaner electrical connectors 720 (see, FIG. 8). The accessory electrical connectors 718 are configured to electrically couple to an additional cleaning accessory (e.g., the surface cleaning head 300) and the cleaner electrical connectors 720 are configured to electrically couple to the vacuum cleaner 400. As such, a power source (e.g., one or more batteries) of the vacuum cleaner 400 may be used to provide power to the additional cleaning accessory. The accessory electrical connectors 718 may be electrically coupled to the cleaner electrical connectors 720 using electrical conductors (e.g., wires) extending within the wand body 702.

Figure 9:
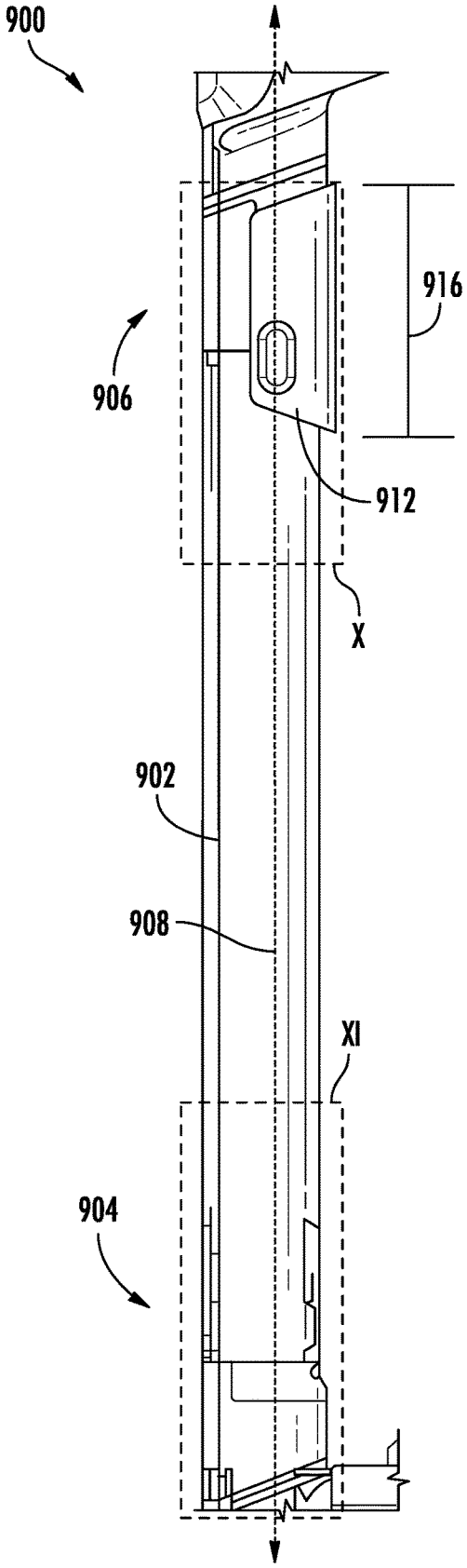
FIG. 9 is a side view of a wand configured to be fluidly coupled to the vacuum cleaner of FIG. 4, consistent with embodiments of the present disclosure.

FIG. 9 shows a side view of a wand 900, which may be an example of the wand 200 of FIG. 2. The wand 900 is another example of a cleaning accessory. As shown, the wand 900 includes a wand body 902 having a wand attachment end 904 and a wand coupling end 906, the wand attachment end 904 being opposite the wand coupling end 906 along a wand longitudinal axis 908. An air channel 910 (see, FIG. 10) is defined within the wand body 902. The air channel 910 extends from the wand attachment end 904 to the wand coupling end 906 and is configured to fluidly couple to, for example, the dust cup 404 of the vacuum cleaner 400.

The wand 900 includes a wand toggle 912. The wand toggle 912 may be slidably coupled to the wand body 902. For example, the wand toggle 912 may be configured to slide along the wand body 902 in a direction substantially (e.g., within 1°, 2°, 3°, 4°, or 5° of) parallel to the wand longitudinal axis 908. Sliding the wand toggle 912 along the wand body 902 causes the wand toggle 912 to transition between a retaining position and a releasing position. Transitioning the wand toggle 912 between the retaining position and the releasing position causes a wand latch 914 (see, FIG. 11) to actuate between a retaining position and a releasing position.

The wand toggle 912 is slidably coupled to the wand body 902 at a location spaced apart from the wand attachment end 904. For example, the wand toggle 912 may be slidably coupled to the wand body 902 at a position that is closer to the wand coupling end 906 than to the wand attachment end 904. In some instances, when the wand 900 is coupled to the vacuum cleaner 400, the wand toggle 912 is spaced apart from the vacuum cleaner 400 by a distance measuring less than a toggle length 916. The toggle length 916 corresponds to a length extending along the wand longitudinal axis 908. As also shown, the wand toggle 912 is configured to extend at least partially around a perimeter of the wand body 902. For example, the wand toggle 912 may extend around at least half the perimeter of the wand body 902.

Figure 10:
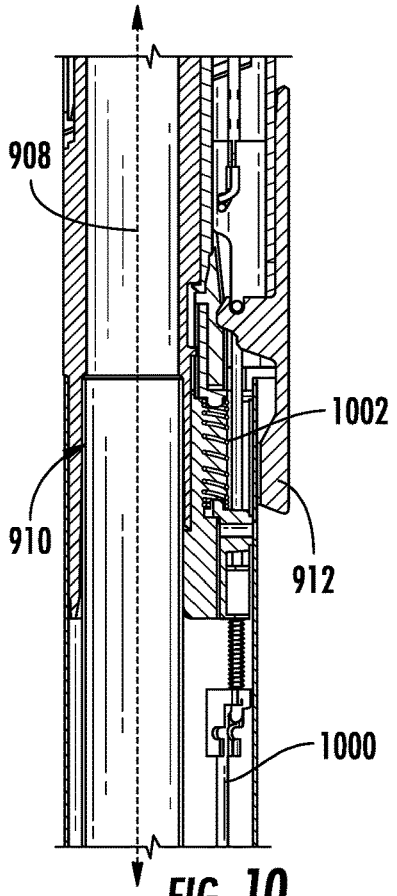
FIG. 10 is a magnified cross-sectional view corresponding to region X of FIG. 9, consistent with embodiments of the present disclosure.

FIG. 10 shows a magnified cross-sectional view corresponding to region X of FIG. 9. As shown, the wand toggle 912 is coupled to a wand pull-rod 1000 such that movement of the wand toggle 912 between the retaining and releasing positions causes a corresponding movement in the wand pull-rod 1000 along the wand longitudinal axis 908. The wand toggle 912 may be urged towards the retaining position using, for example, a biasing mechanism 1002 (e.g., a spring).

Figure 11:
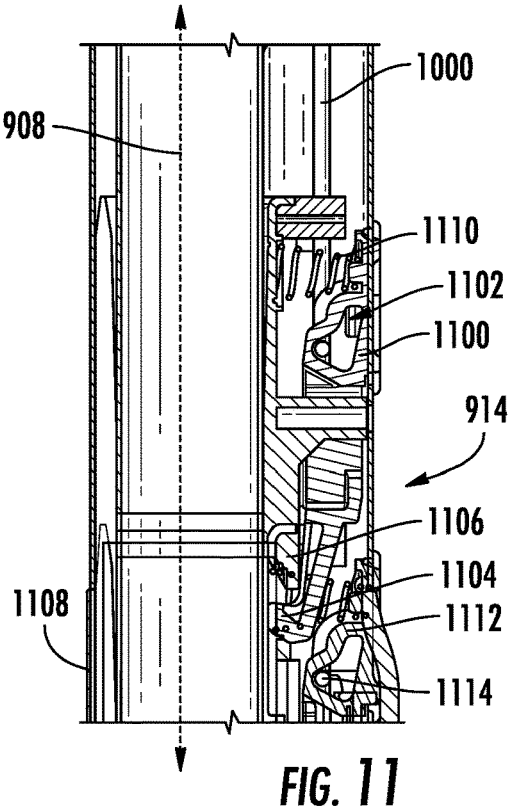
FIG. 11 is a magnified cross-sectional view corresponding to region XI of FIG. 9, consistent with embodiments of the present disclosure.

FIG. 11 shows a magnified cross-sectional view corresponding to region XI of FIG. 9. As shown, the wand pull-rod 1000 is coupled to the wand latch 914 such that movement of the wand pull-rod 1000 along the wand longitudinal axis 908 causes the wand latch 914 to transition between a retaining and releasing position. The wand pull-rod 1000 is coupled to the wand latch 914 at a receptacle 1100. The receptacle 1100 defines one or more ramped surfaces 1102 configured to slidably engage a portion of the wand pull-rod 1000. As the wand pull-rod 1000 moves along the one or more ramped surfaces 1102, the wand latch 914 is caused to pivot. Pivotal movement of the wand latch 914 between the retaining and releasing position causes a paw 1104 of the wand latch 914 to move into or out of engagement with an accessory catch 1106 of an accessory 1108 (e.g., the surface cleaning head 300 of FIG. 3). The wand latch 914 may be urged towards the retaining position by a biasing mechanism 1110 (e.g., a spring). As also shown, the wand latch 914 can be configured to engage a secondary latch 1112 when pivotally moving from the retaining position to the releasing position. As such, the pivotal movement of the wand latch 914 may cause a corresponding movement in the secondary latch 1112. Movement of the secondary latch 1112 may cause a secondary rod 1114 (e.g., a pushrod or a pull-rod) to move.

Figure 12:
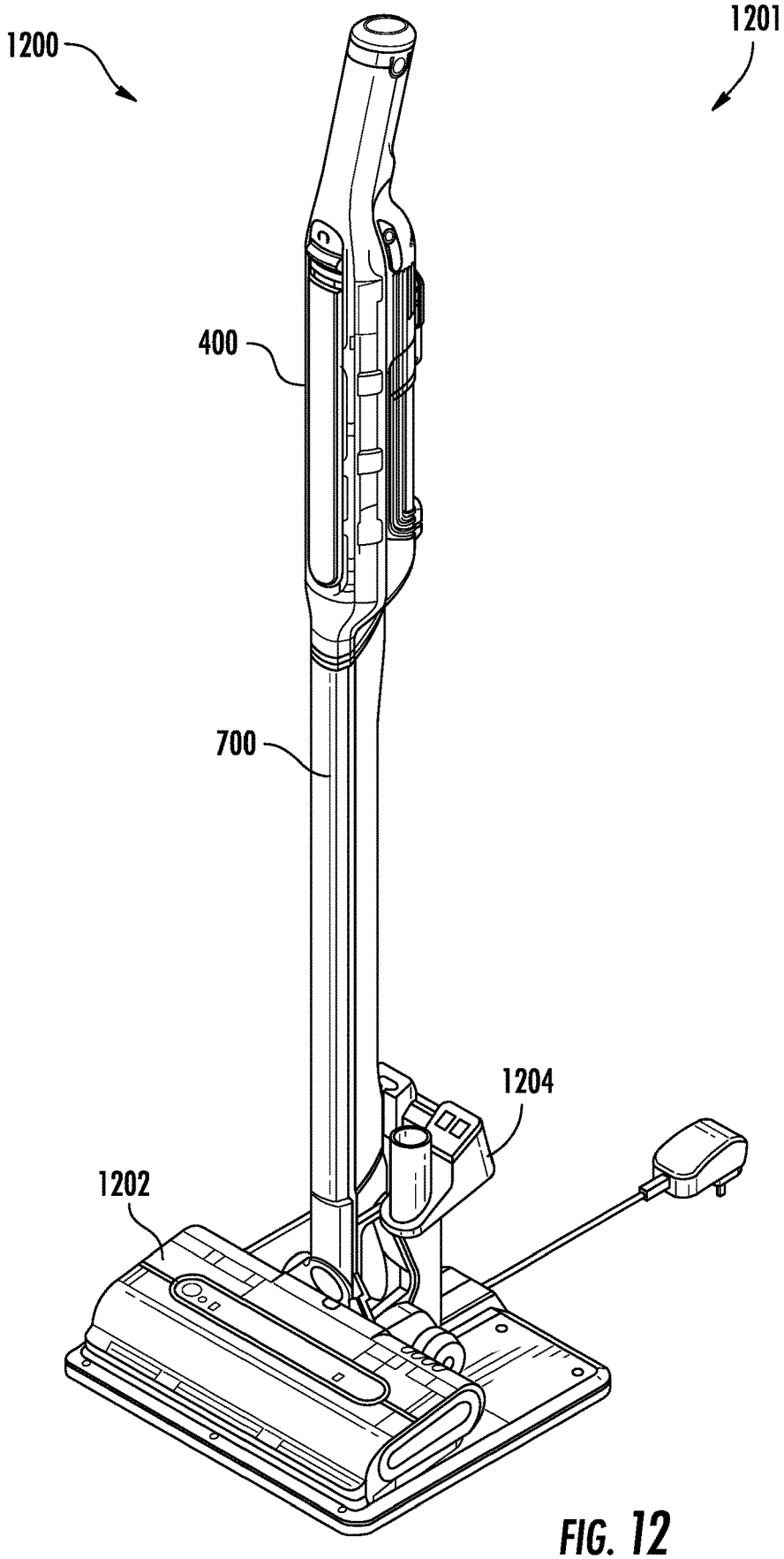
FIG. 12 is a perspective view of a cleaning assembly coupled to a docking station, consistent with embodiments of the present disclosure.

FIG. 12 shows a perspective view of a cleaning system 1201 having a cleaning assembly 1200 and a docking station 1204. The cleaning assembly 1200 includes the vacuum cleaner 400, the wand 700, and a surface cleaning head 1202 (which may be an example of the surface cleaning head 300 of FIG. 3). The vacuum cleaner 400 is removably coupled to the wand 700 and the wand 700 is removably coupled to the surface cleaning head 1202. The vacuum cleaner 400 is fluidly coupled to the surface cleaning head 1202 via the wand 700. As such, in operation, the vacuum cleaner 400 causes a suction force to be generated at the surface cleaning head 1202. In some instances, the surface cleaning head 1202 may be configured to be directly coupled to the vacuum cleaner 400.

As shown, in some instances, the cleaning assembly 1200 may be configured to be removably coupled to a docking station 1204. The docking station 1204 may be configured to charge one or more batteries of the cleaning assembly 1200. For example, one or more of the surface cleaning head 1202 and/or the vacuum cleaner 400 may include one or more batteries. In some instances, the vacuum cleaner 400 may be decoupled from the wand 700 while the wand 700 and the surface cleaning head 1202 remain coupled to the docking station 1204. In this instance, if the surface cleaning head 1202 includes one or more batteries, the one or more batteries may continue to be charged while the vacuum cleaner 400 is being used. For example, one or more batteries may be included within a handle of the vacuum cleaner 400. In this example, the one or more batteries may be removable from the handle such that the one or more batteries may be charged separate from the vacuum cleaner (e.g., using a battery charging cradle on the docking station 1204).

Figure 13:
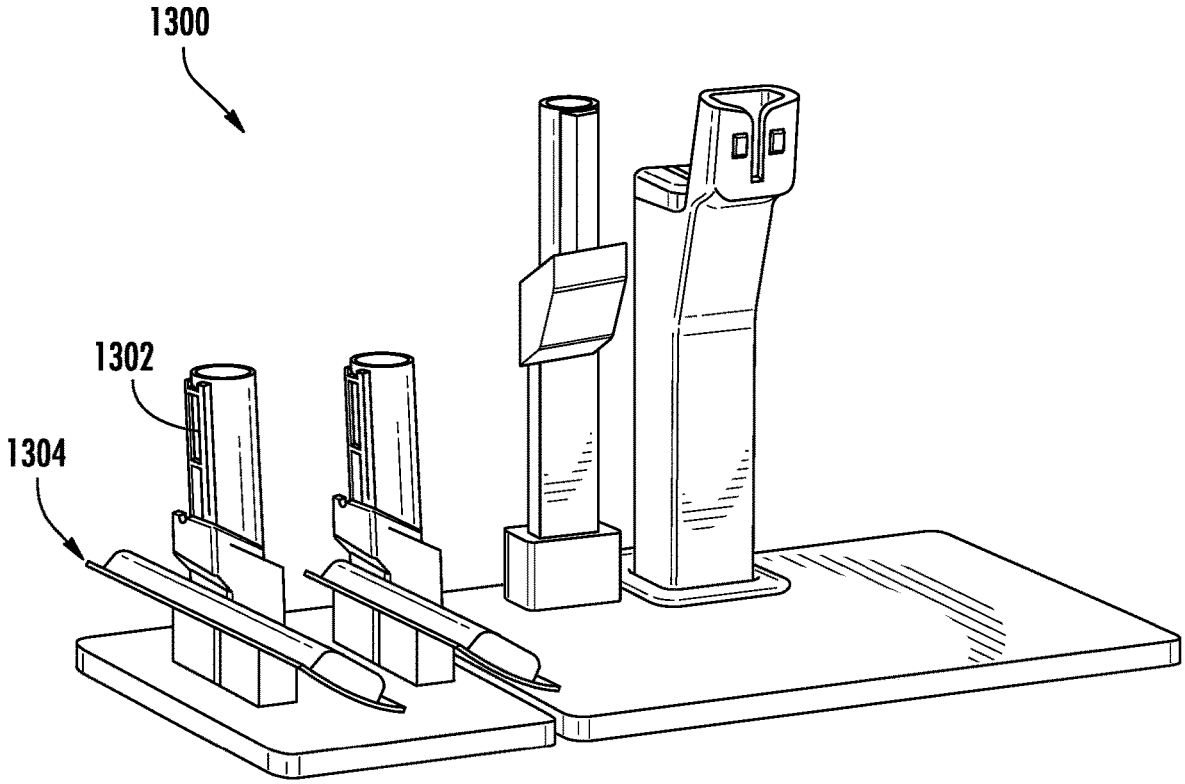
FIG. 13 shows a perspective view of a docking station, consistent with embodiments of the present disclosure.

FIG. 13 shows another example of a docking station 1300. As shown, the docking station 1300 is configured to couple to one or more cleaning accessories 1302. The one or more cleaning accessories 1302 may be coupled to the docking station 1300 such that they may couple to, for example, the vacuum cleaner 400 without a user having to first remove a respective cleaning accessory 1302 from the docking station 1300. In other words, the one or more accessories 1302 are coupled to the docking station 1300 at an accessory inlet end 1304 of the one or more accessories 1302.

Figure 14:
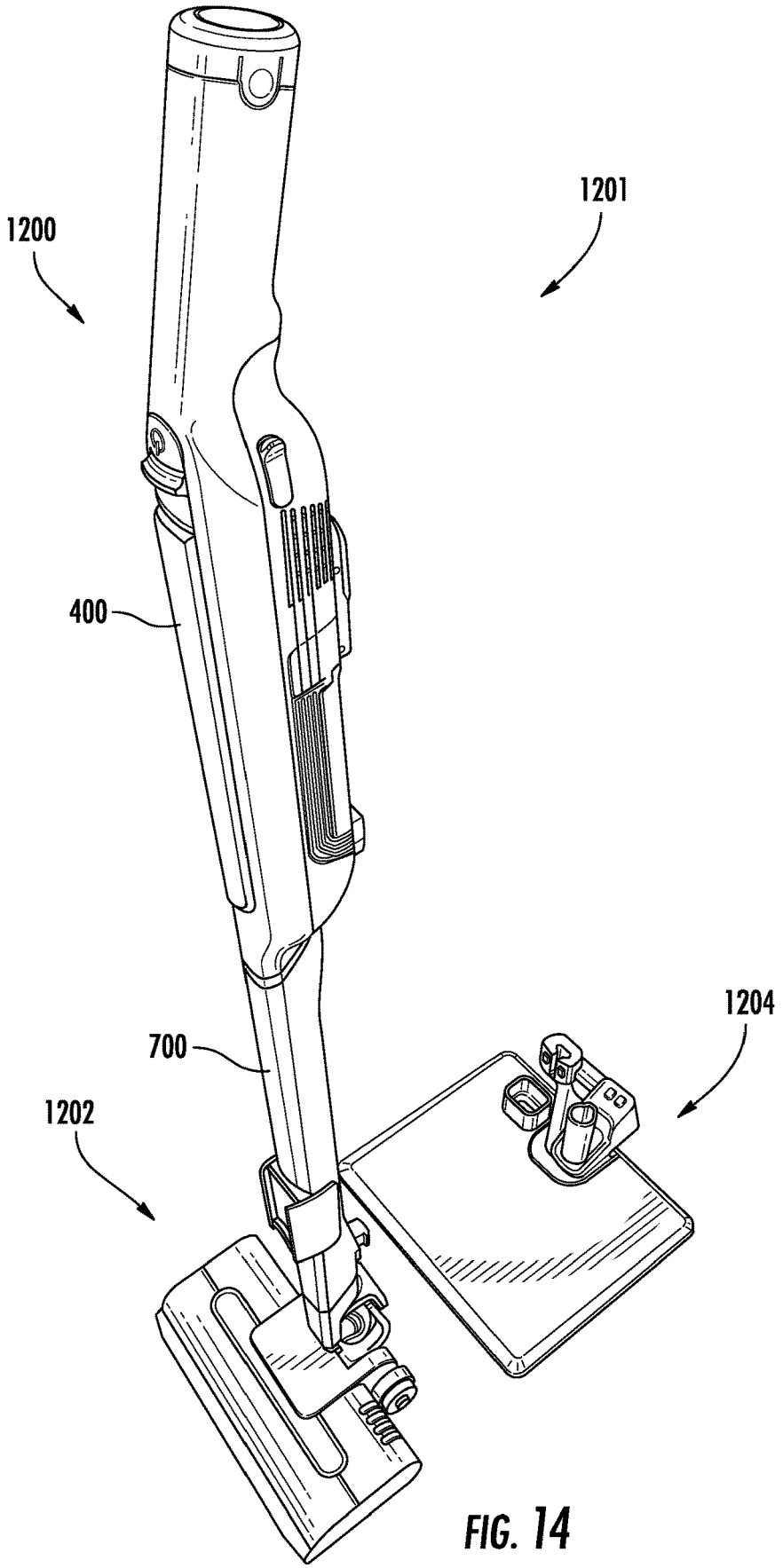
FIG. 14 is another view of the docking station of FIG. 12 in an undocked state, consistent with embodiments of the present disclosure.
Figure 15:
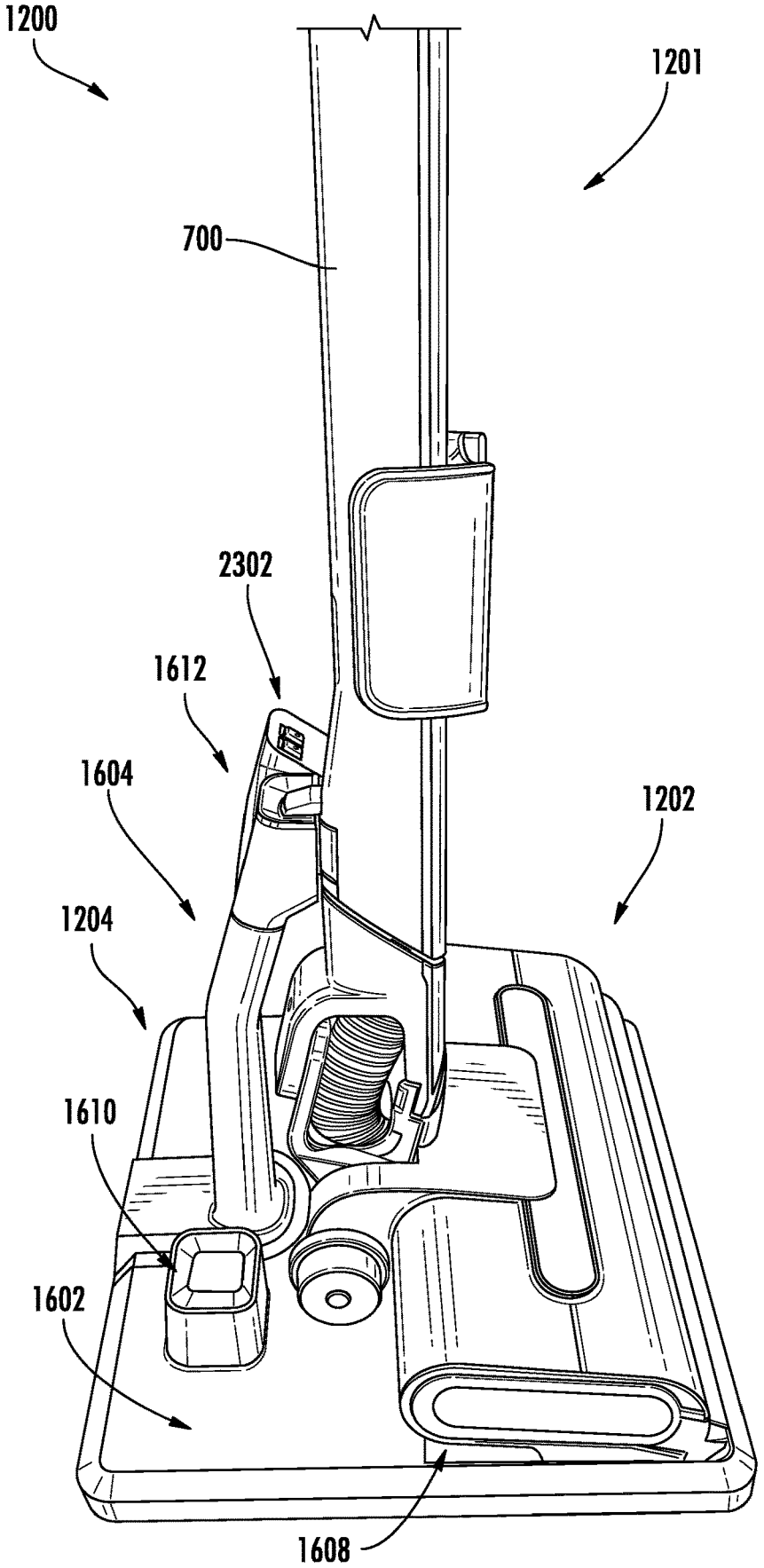
FIG. 15 generally illustrates the docking station and cleaning system in a first docked state, consistent with embodiments of the present disclosure.

Turning now to FIGS. 14-15, additional figures illustrating the cleaning system 1201 of FIG. 12 having a cleaning assembly 1200 and a docking station 1204 are generally illustrated. In particular, FIG. 14 generally illustrates the cleaning system 1201 in an undocked state (i.e., in which the cleaning assembly 1200 is not coupled to the docking station 1204) and FIG. 15 generally illustrates the cleaning system 1201 in a first docked state (i.e., in which at least a portion of the cleaning assembly 1200 is coupled to the docking station 1204). As described herein, a portion of the cleaning system 1201 may also be docked to the docking station 1204 in one or more alternative (e.g., second) configurations.

With reference to FIG. 14, the cleaning assembly 1200 includes the vacuum cleaner 400, the wand 700, and a surface cleaning head 1202 (which may be an example of the surface cleaning head 300 of FIG. 3). The vacuum cleaner 400 is removably coupled to the wand 700 and the wand 700 is removably coupled to the surface cleaning head 1202. The vacuum cleaner 400 is fluidly coupled to the surface cleaning head 1202 via the wand 700. As such, in operation, the vacuum cleaner 400 causes a suction force to be generated at the surface cleaning head 1202. In some instances, the surface cleaning head 1202 may be configured to be directly coupled to the vacuum cleaner 400.

As shown, in some instances, the cleaning assembly 1200 may be configured to be removably coupled to a docking station 1204. The docking station 1204 may be configured to charge one or more batteries of the cleaning assembly 1200. For example, one or more of the surface cleaning head 1202 and/or the vacuum cleaner 400 may include one or more batteries. As explained herein, the batteries of the cleaning assembly 1200 (e.g., but not limited to batteries disposed in the vacuum cleaner 400) may be charged in a first docking state and a second docking state.

Figure 16A:
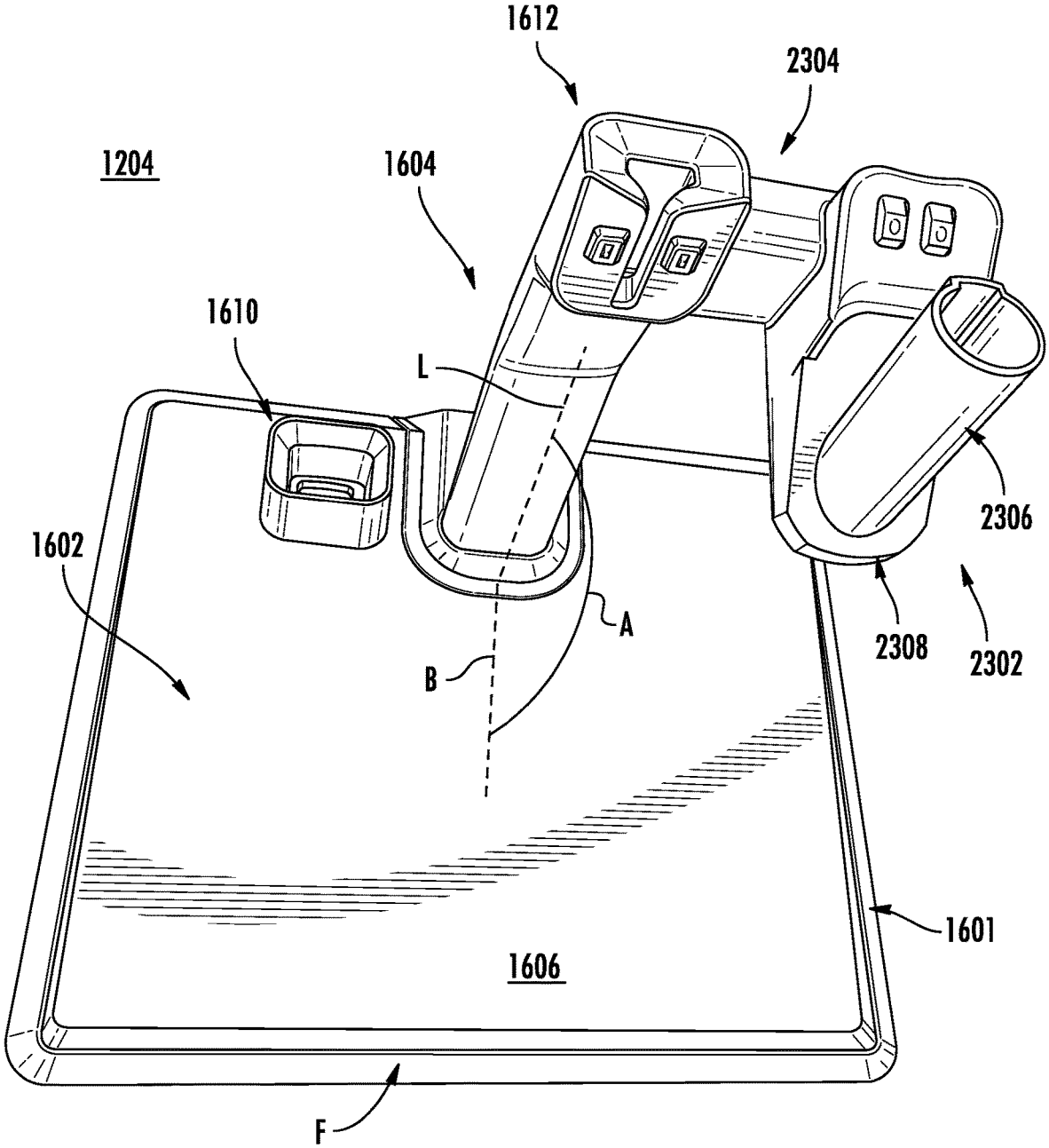
FIG. 16A generally illustrates one view of the docking station of FIG. 14, consistent with embodiments of the present disclosure.
Figure 16B:
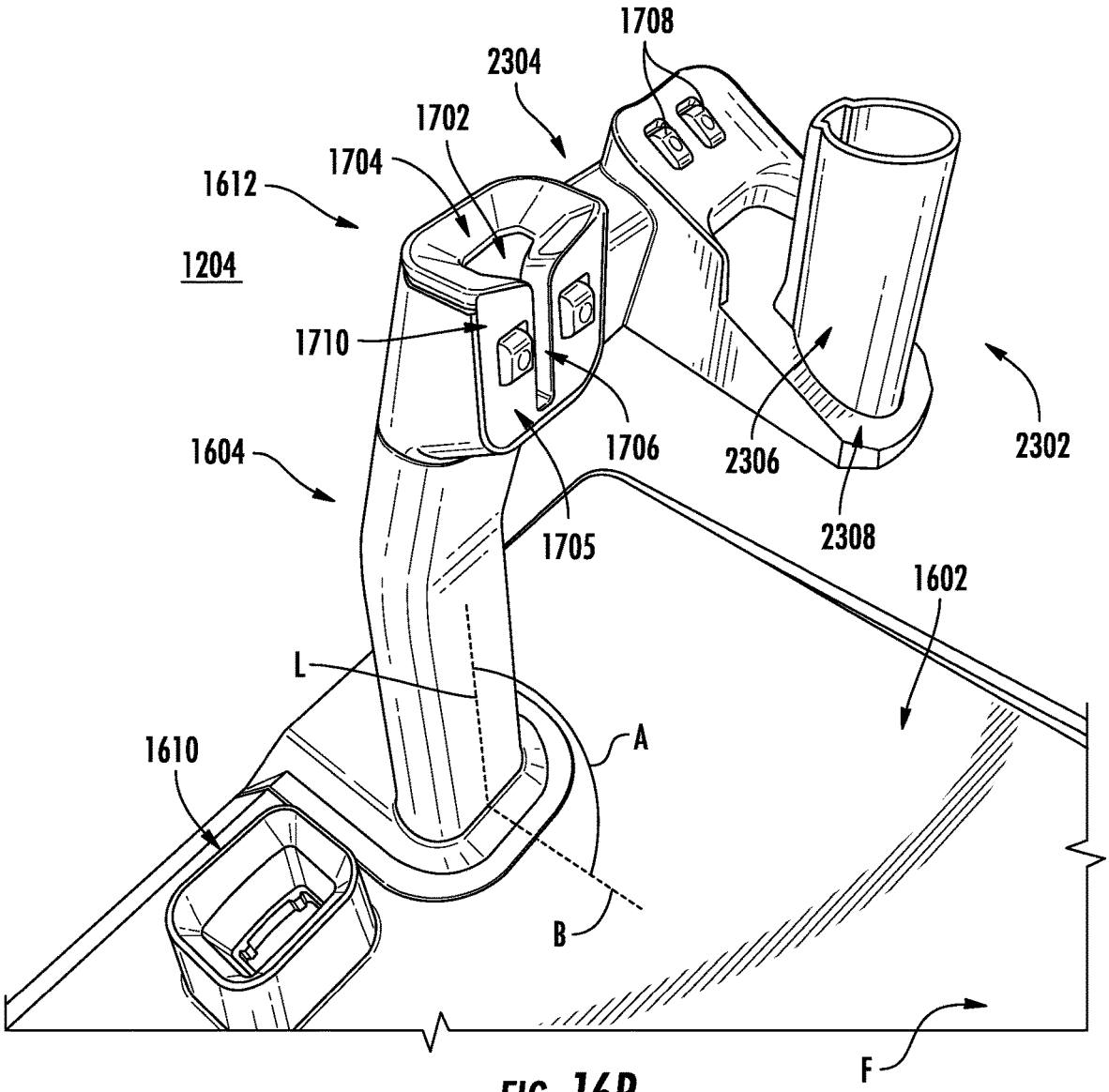
FIG. 16B generally illustrates another view of the docking station of FIG. 14, consistent with embodiments of the present disclosure.

Turning to FIGS. 16A and 16B, an example of the docking station 1204 is shown. The docking station 1204 may include support base 1602 and a support arm 1604 extending therefrom. The support base 1602 may be configured to support the cleaning assembly 1200 when in the first docked state and may include a lower surface 1601 configured to be disposed on the floor. For example, the surface cleaning head 1202 may contact an upper surface 1606 of the support base 1602 when in the first docked state as generally illustrated in FIG. 15. While the upper surface 1606 of the support base 1602 is shown having a surface area that is at least as large as the bottom surface 1608 of the cleaning assembly 1200, it should be appreciated that the surface area of the upper surface 1606 of the support base 1602 may be smaller than the bottom surface 1608 of the cleaning assembly 1200. In such an embodiment, a portion of the bottom surface 1608 of the cleaning assembly 1200 may not be disposed on the support base 1602 when in the first docked state.

The docking station 1204 may optionally include one or more accessory holders 1610. The accessory holders 1610 may be configured to secure one or more accessories associated with the cleaning assembly 1200 to facilitate organization and storage of the accessories. Non-limiting examples of accessories include different types of nozzles, brushes, crevice tools, and/or the like which may be removably coupled to the vacuum cleaner 400 and/or wand 700. In at some examples, the accessory holders 1610 may define a cavity configured to receive and/or support the accessories. In at least one example, the accessories may include additional battery packs. The accessory holders 1610 may optionally include charging terminals to charge the additional battery packs. One or more of the accessory holders 1610 may be disposed on and/or extend from the support base 1602 (e.g., but not limited to, the upper surface 1606 of the support base 1602).

Figure 17:
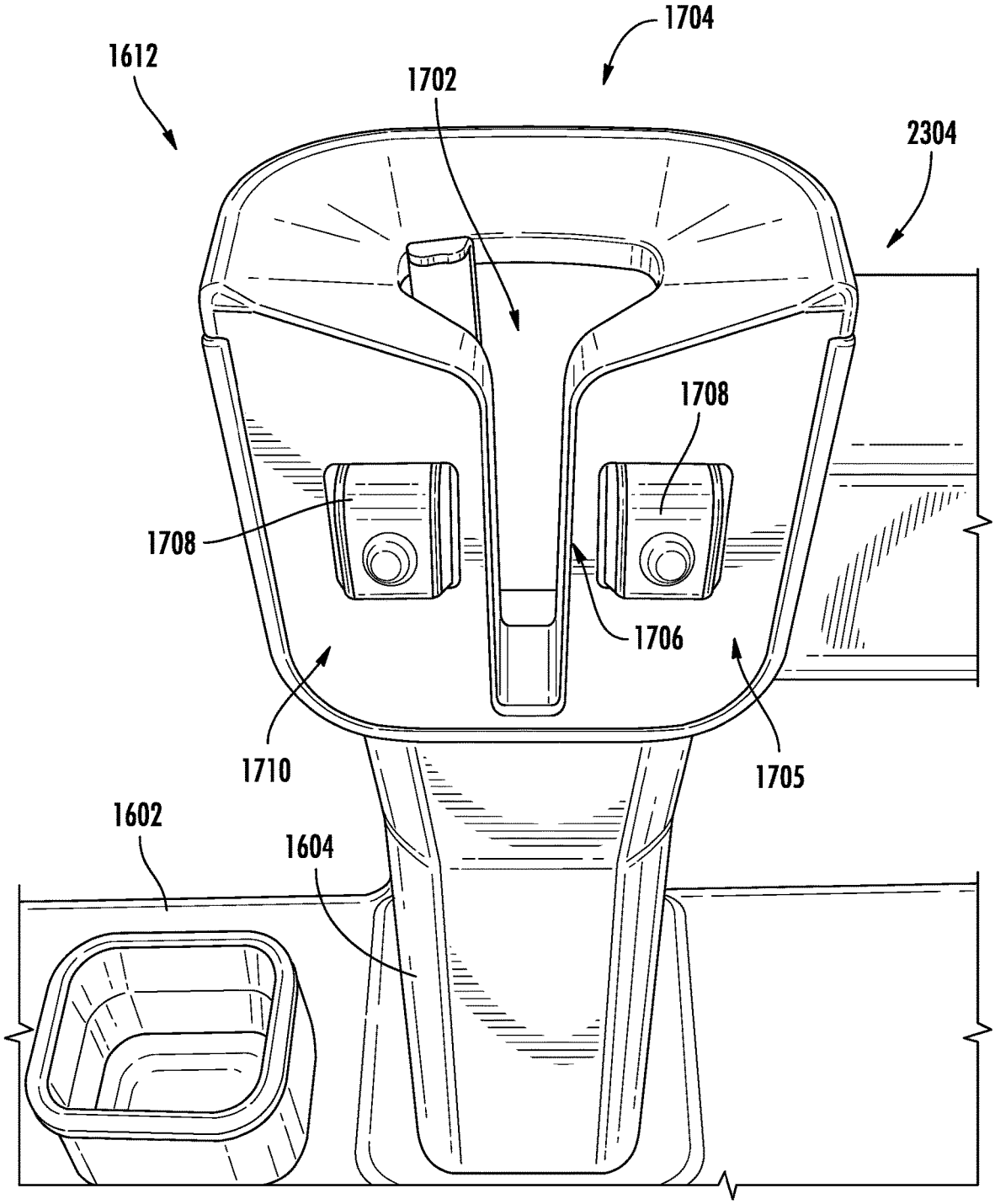
FIG. 17 generally illustrates one example of the first base coupler of FIG. 14, consistent with embodiments of the present disclosure.

The support arm 1604 may be configured to extend from the support base 1602 and configured to be removably coupled to the cleaning assembly 1200. The support arm 1604 may extend at an angle A from the support base 1602. Angle A may be defined as an angle between the longitudinal axis L of the support arm 1604 and a line B extending from the support arm 1604 towards the front F of the support base 1602 along the upper surface 1606 of the support base 1602 as generally illustrated in FIG. 17. The angle A may be in the range of 20 degrees to 135 degrees, for example, 90 degrees. When angle A is less than 90 degrees, the support arm 1604 may lean towards the front F of the support base 1602. In contrast, the support arm 1604 may lean away from the front F of the support base 1602 when angle A is greater than 90 degrees.

Figure 18:
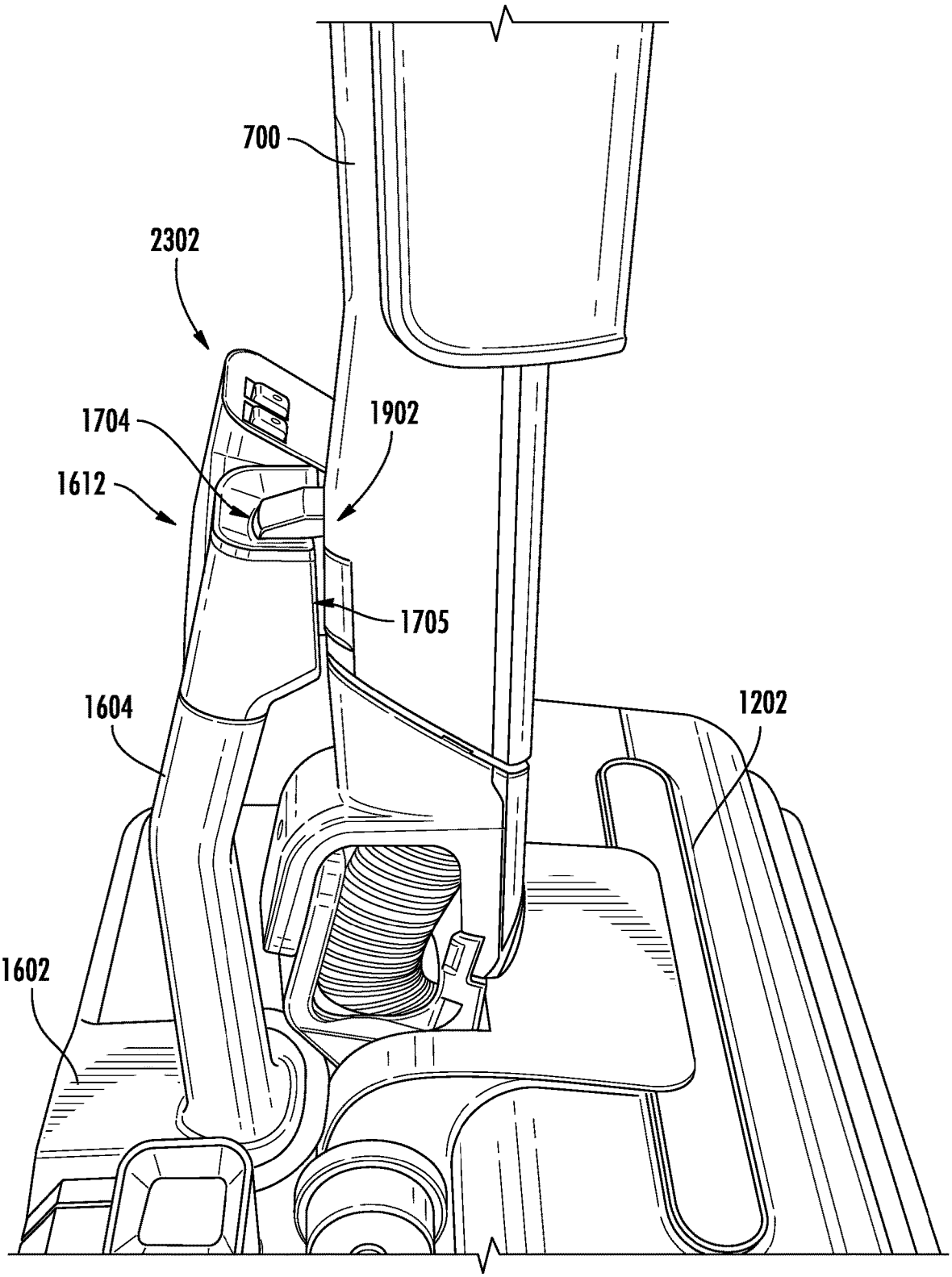
FIG. 18 generally illustrates another view of the docking station and cleaning system in a first docked state, consistent with embodiments of the present disclosure.
Figure 19:
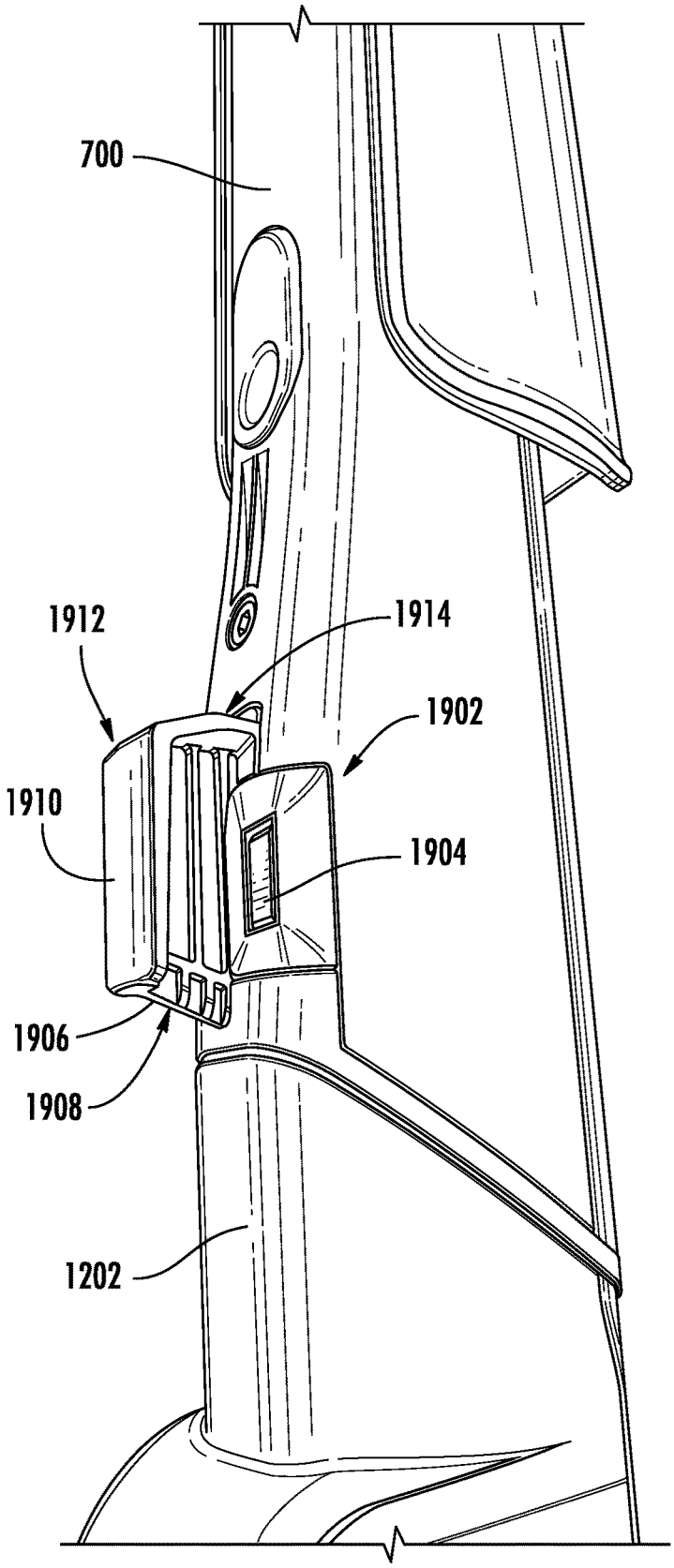
FIG. 19 generally illustrates one example of the cleaning assembly coupler of FIG. 14, consistent with embodiments of the present disclosure.
Figure 20:
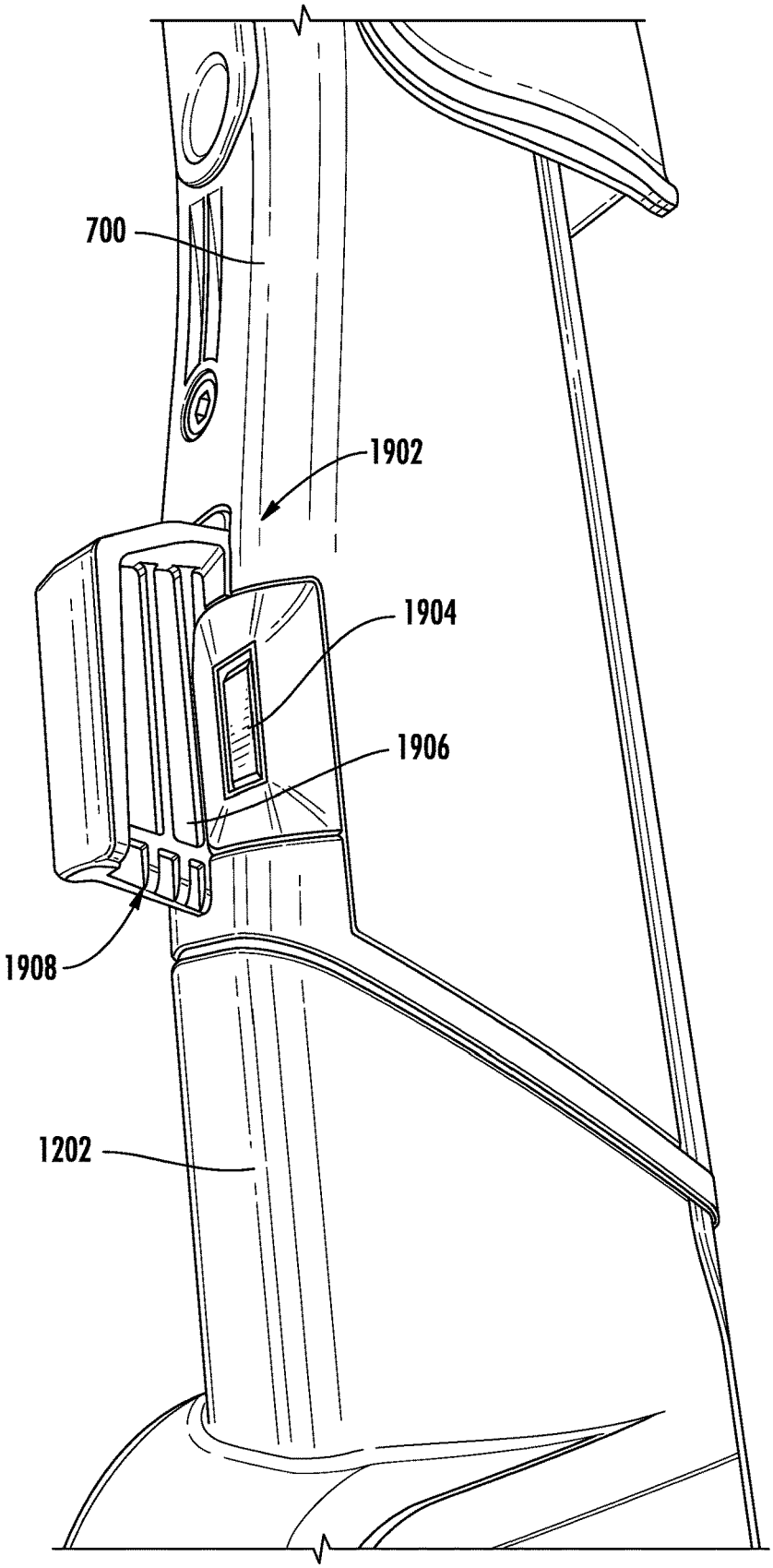
FIG. 20 generally illustrates another view of the cleaning assembly coupler, consistent with embodiments of the present disclosure.
Figure 21:
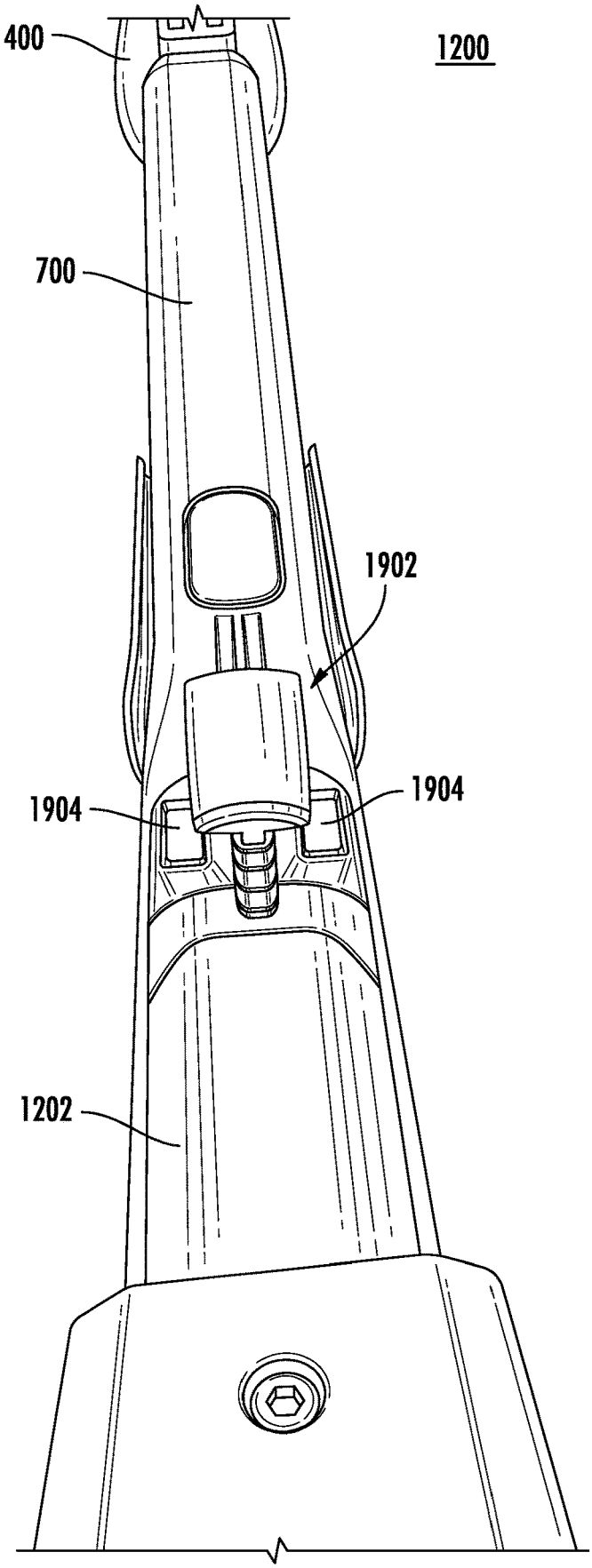
FIG. 21 generally illustrates a further view of the cleaning assembly coupler, consistent with embodiments of the present disclosure.
Figure 22:
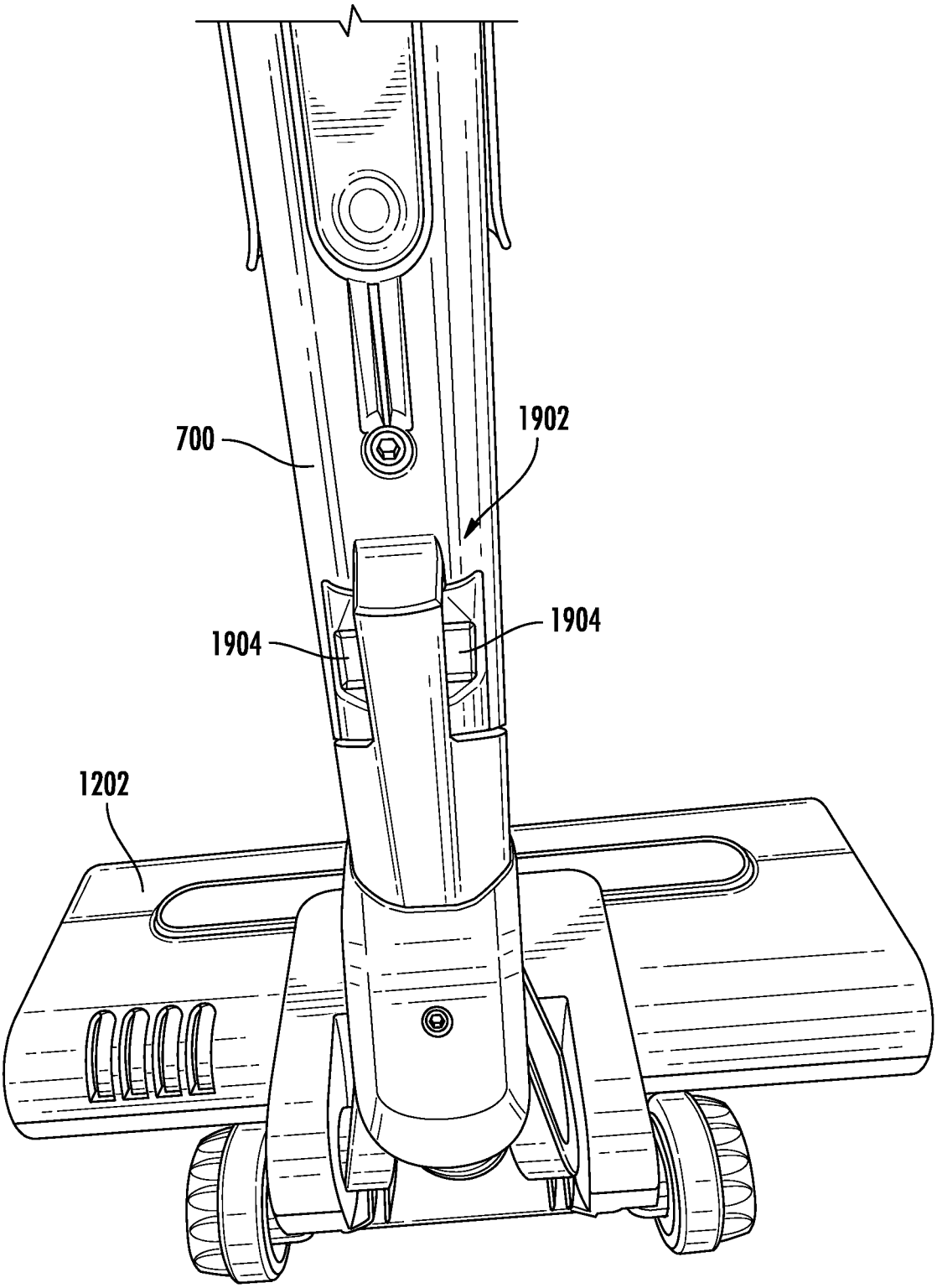
FIG. 22 generally illustrates yet another view of the cleaning assembly coupler, consistent with embodiments of the present disclosure.

With reference to FIGS. 16A-21, the support arm 1604 may include one or more first base couplers 1612 (see, e.g., FIG. 16A, 16B) configured to engage with one or more cleaning assembly couplers 1902 (see, e.g., FIG. 19). For example, the first base coupler 1612 may be configured to receive at least a portion of the cleaning assembly coupler 1902 to secure a least a portion of the cleaning assembly 1200 to the docking station 1204 in the first docked state, e.g., as generally illustrated in FIGS. 15 and 18.

In at least one example, the wand 700 may be coupled to the vacuum cleaner 400 and the surface cleaning head 1202 when the cleaning assembly 1200 is coupled to the first base coupler 1612 in the first docked state. For example, the wand 700 and the vacuum cleaner 400 may extend generally upwards (e.g., generally perpendicular) from the upper surface 1606 of the support base 1602 when in the first docked state. The surface cleaning head 1202 may optionally be disposed on the upper surface 1606 of the support base 1602 when in the first docked state.

In at least some examples, the vacuum cleaner 400 is not coupled to the wand 700 in the first docked state. For example, both the wand 700 and the surface cleaning head 1202 may be coupled to the first base coupler 1612 in the first docked state (the first base coupler 1612 may be part of either the wand 700 or the surface cleaning head 1202). Alternatively, only the surface cleaning head 1202 may be coupled to the first base coupler 1612 in the first docked state (e.g., the surface cleaning head 1202 may be coupled to the first base coupler 1612 without the wand 700 in the first docked state). In any event, the surface cleaning head 1202 may optionally be disposed on the upper surface 1606 of the support base 1602 when in the first docked state.

With reference to FIG. 17, a close-up of one example of the first base coupler 1612 of FIG. 16A, 16B is generally illustrated. The first base coupler 1612 may include a passageway 1702 extending from an opening 1704. The passageway 1702 and the opening 1704 may be configured to receive at least a portion of the cleaning assembly coupler 1902 (e.g., as generally illustrated in FIGS. 15 and 18). The opening 1704 may include a tapered opening configured to generally guide the cleaning assembly coupler 1902 towards and/or into the passageway 1702. The passageway 1702 may have an inner cross-sectional size that generally corresponds to the outer cross-sectional size of the cleaning assembly coupler 1902 such that the cleaning assembly coupler 1902 can generally only move along the longitudinal axis La of the passageway 1702 (e.g., generally only up/down). In at least one example, the inner cross-section of the passageway 1702 may have a taper which gets smaller moving away from the opening 1704. Optionally, the taper of the passageway 1702 may generally correspond to a taper of the cleaning assembly coupler 1902.

The distal end of the passageway 1702 may be open or may be a blind passageway (e.g., a blind hole). In at least one example, the passageway 1702 may have a length of at least 2 centimeters (cm), for example, a length of at least 3 cm, a length of at least 4, a length of at least 5 cm, and/or any value or range therein. The slot may have a length that is substantially the same as the passageway 1702 or may have a length that is shorter than the passageway 1702 (e.g., at least 50% of the length of the passageway 1702, at least 75% of the length of the passageway 1702, at least 90% of the length of the passageway 1702, and/or any value or range therein). The passageway 1702 may have a width (e.g., left to right when viewed from the front F) of about 1-3 cm, for example, about 2 cm, and depth (e.g., front to back) of about 0.25 to 1.0 cm, for example, about 0.5 cm. The slot 1706 may have a width (e.g., left to right) of about 0.25 to 1.0 cm, for example, about 0.5 cm, and depth (e.g., front to back) of about 0.25 to 1.0 cm, for example, about 0.5 cm. Of course, these are merely exemplary ranges.

The first base coupler 1612 may also optionally include one or more slots 1706. The slot 1706 may extend from the opening 1704 along a front face 1705 of the first base coupler 1612 (e.g., a surface of the arm coupler that generally faces the front F of the support base 1610). In the illustrated example, the front face 1705 is generally planar, though this is not a limitation of the present disclosure unless claimed as such. In some examples, the front face 1705 may have profile (e.g., shape or contour) that generally inversely corresponds to the profile of area proximate to the cleaning assembly coupler 1902. The slot 1706 may also run along the passageway 1702. In at least one example, the passageway 1702 and the slot 1706 may generally form an elongated T-shaped channel configured to receive a portion of an elongated T-shaped connector of the cleaning assembly coupler 1902 at the opening 1704. Of course, the passageway 1702 and the slot 1706 (and the corresponding portion of the cleaning assembly coupler 1902) may have other shapes such as, but not limited to, Y-shapes, U-shapes, or the like.

The first base coupler 1612 may therefore be configured to receive at least a portion of the cleaning assembly coupler 1902 to removably secure the cleaning assembly 1200 to the docking station 1204, for example to store at least a portion of the cleaning assembly 1200 on the docking station 1204. In at least one example, the support arm 1604 and the first base coupler 1612 may be configured to be secured to a portion of the wand 700 of the cleaning assembly 1200. The wand 700 may also be simultaneously secured to the vacuum cleaner 400 and/or the surface cleaning head 1202. As such, the support arm 1604 and the first base coupler 1612 may be configured to be secured to the entire cleaning assembly 1200 (i.e., the vacuum cleaner 400, wand 700, and the surface cleaning head 1202). This allows the user to easily store the cleaning assembly 1200 without having to disassemble the vacuum cleaner 400, the wand 700, and the surface cleaning head 1202 from each other.

The support arm 1604 and the first base coupler 1612 may be disposed a sufficient distance from the support base 1602 to increase the overall stability and generally prevent the cleaning assembly 1200 from accidentally tipping over when in the first docked state. For example, the support arm 1604 and the first base coupler 1612 may therefore be disposed a sufficient distance from the support base 1602 to allow the surface cleaning head 1202 to be disposed on the upper surface 1606 of the support base 1602 when in the first docked state. Such a configuration allows the weight of the cleaning assembly 1200 to be transferred directly to the support base 1602, and the support arm 1604 only has to stabilize the cleaning assembly 1200. Alternatively (or in addition), the cleaning assembly coupler 1902 may be part of the wand 700. Forming the cleaning assembly coupler 1902 as part of the wand 700 may increase the stability of the cleaning assembly 1200 when in the first docked state. It should be appreciated, however, that the cleaning assembly coupler 1902 may be part of the surface cleaning head 1202. In at least one example, the first base coupler 1612 is disposed at least 10 cm from the support base 1602, for example, at least 15 cm from the support base 1602, at least 20 cm from the support base 1602, at least 30 cm from the support base 1602, and/or any value or range therein, when in the first docking state. The cleaning assembly coupler 1902 may be disposed at least 10 cm from the support base 1602, for example, at least 15 cm from the support base 1602, at least 20 cm from the support base 1602, at least 30 cm from the support base 1602, and/or any value or range therein, when in the first docking state.

The first base coupler 1612 may optionally include one or more docking charging terminals 1708 configured to be electrically coupled to corresponding vacuum charging terminals 1904 associated with the cleaning assembly 1200 when the cleaning assembly 1200 is in the first docked state. The docking charging terminals 1708 and vacuum charging terminals 1904 may be configured to supply electrical power to one or more batteries associated with the cleaning assembly 1200. The batteries may be located anywhere in the cleaning assembly 1200 such as, but not limited to, the vacuum cleaner 400, the wand 700, and/or the surface cleaning head 1202. The first base coupler 1612 (e.g., the passageway 1702 and/or slot 1706) may be configured to receive the corresponding cleaning assembly coupler 1902 to generally align the docking charging terminals 1708 with the vacuum charging terminals 1904 when the cleaning assembly 1200 is in the first docked state.

In at least one example, one or more of the docking charging terminals 1708 may be at least partially disposed on an outer surface 1710 of the first base coupler 1612. For example, one or more of the docking charging terminals 1708 may be disposed on the front face 1705 of the first base coupler 1612. In at least one example, a first and a second docking charging terminal 1708 may be disposed on opposite sides of the slot 1706. Alternatively (or in addition), one or more of the docking charging terminals 1708 may be at least partially disposed within the passageway 1702.

Turning now to FIGS. 19-22, one example of the cleaning assembly coupler 1902 is generally illustrated. As described herein, the cleaning assembly coupler 1902 may be configured to engage with one or more first base couplers 1612 to secure at least a portion of the cleaning assembly 1200 to the docking station 1204 in the first docked state. The cleaning assembly coupler 1902 may be configured to be at least partially received in the passageway 1702 and/or slot 1706 of the first base coupler 1612. The cleaning assembly coupler 1902 may include one or more ribs 1906 extending outward from the cleaning assembly 1200. In the illustrated example, the rib 1906 extends from the wand 700; however, it should be appreciated that the rib 1906 may extend from the surface cleaning head 1202.

A distal end region 1908 of the cleaning assembly coupler 1902 (e.g., a distal end region of the rib 1906) may be configured to be received through the opening 1704 and into the passageway 1702 and/or slot 1706 of the first base coupler 1612. The cleaning assembly coupler 1902 may also include one or more flanges 1910 extending outward from the rib 1906. The flanges 1910 may also be configured to be received through the opening 1704 and into the passageway 1702 of the first base coupler 1612. In the illustrated example, the rib 1906 and the flanges 1910 form an elongated T-shaped connector which generally corresponds to the elongated T-shaped channel of the first base coupler 1612 as described herein, though it should be appreciated that the rib 1906 and the flanges 1910 may have other shapes such as, but not limited to, Y-shapes, U-shapes, or the like.

A proximal end region 1912 of the cleaning assembly coupler 1902 may include an end cap 1914. The end cap 1914 may generally limit the distance that the cleaning assembly coupler 1902 may advance into the first base coupler 1612. The first base coupler 1612 and cleaning assembly coupler 1902 may each be sized and shaped relative to each other, and positioned relative to the support base 1602 of the docking station 1204 and the cleaning assembly 1200, respectively, such that the surface cleaning head 1202 may be disposed on the upper surface 1606 of the support base 1602 when in the first docked state.

The first base coupler 1612 and cleaning assembly coupler 1902 may each be sized and shaped relative to each other, and positioned relative to the support base 1602 of the docking station 1204 and the cleaning assembly 1200, respectively, such that the vacuum charging terminals 1904 are electrically coupled to the docking charging terminals 1708 when in the first docked state. The vacuum charging terminals 1904 may be disposed proximate to the cleaning assembly coupler 1902. For example, a first and a second vacuum charging terminal 1904 may be disposed on opposite sides of the rib 1906.

To remove (i.e., undock) the cleaning assembly 1200 from the docking station 1204, the user may simply lift the cleaning assembly 1200 upwards to back the cleaning assembly coupler 1902 out of the first base coupler 1612 (e.g., to cause the distal end 1908 of the rib 1906 and flanges 1910 to be advanced out of the passageway 1702, slot 1706, and opening 1704). While no locking mechanism is necessary, the first base coupler 1612 and/or the cleaning assembly coupler 1902 may optionally include a lock to fix the position of the cleaning assembly 1200 relative to the docking station 1204.

It should be appreciated that the configuration of the first base coupler 1612 and the cleaning assembly coupler 1902 may be reversed (e.g., the cavity and rib may be reversed such that the first base coupler 1612 forms a T-connector (or the like) and the cleaning assembly coupler 1902 forms a T-channel (or the like). Of course, it should also be appreciated that the first base coupler 1612 and the cleaning assembly coupler 1902 are not limited to a channel/connector configuration unless specifically claimed as such.

The docking station 1204 may optionally include a second base coupler 2302 configured to engage with one or more vacuum couplers 2502 associated with the vacuum cleaner 400 in a second docked state. Whereas the first base coupler 1612 may be configured to secure (and optionally charge) the entire cleaning assembly 1200 (or optionally just the wand 700 and the surface cleaning head 1202), the second base coupler 2302 may be configured to secure (and optionally charge) just the vacuum cleaner 400 in the second docked state. The second base coupler 2302 may be configured to position the vacuum cleaner 400 at an easily reachable location relative to the docking station 1204 and may allow quick and easy access to the vacuum cleaner 400 from the docking station 1204 for situations where the wand 700 and surface cleaning head 1202 are not needed/desired. It should be appreciated that the docking station 1204 may advantageously allow the wand 700 and the surface cleaning head 1202 to be stored separately from, and at the same time as, the vacuum cleaner 400. To this end, the docking station 1204 may be configured to store the wand 700 and the surface cleaning head 1202 using the first base coupler 1612 and the cleaning assembly coupler 1902 (and optionally simultaneously charge using docking charging terminals 1708 and vacuum charging terminals 1904) in the first docked state, while the vacuum cleaner 400 is simultaneously stored using the second base coupler 2302 and vacuum couplers 2502 (and optionally simultaneously charge using charging terminals described herein) in the second docked state. As a result, the user can quickly and easily undock the vacuum cleaner 400 from the second base coupler 2302 and the docking station 1204 and use just the vacuum cleaner 400 if desired, or quickly disconnect the vacuum cleaner 400 from the base coupler 2302 and easily connect it to the wand 700 and thereafter remove the assembled cleaning assembly 1200 (e.g., vacuum cleaner 400, wand 700, and surface cleaning head 1202) from the first base coupler 1612 (and from the docking station 1204).

Figure 23:
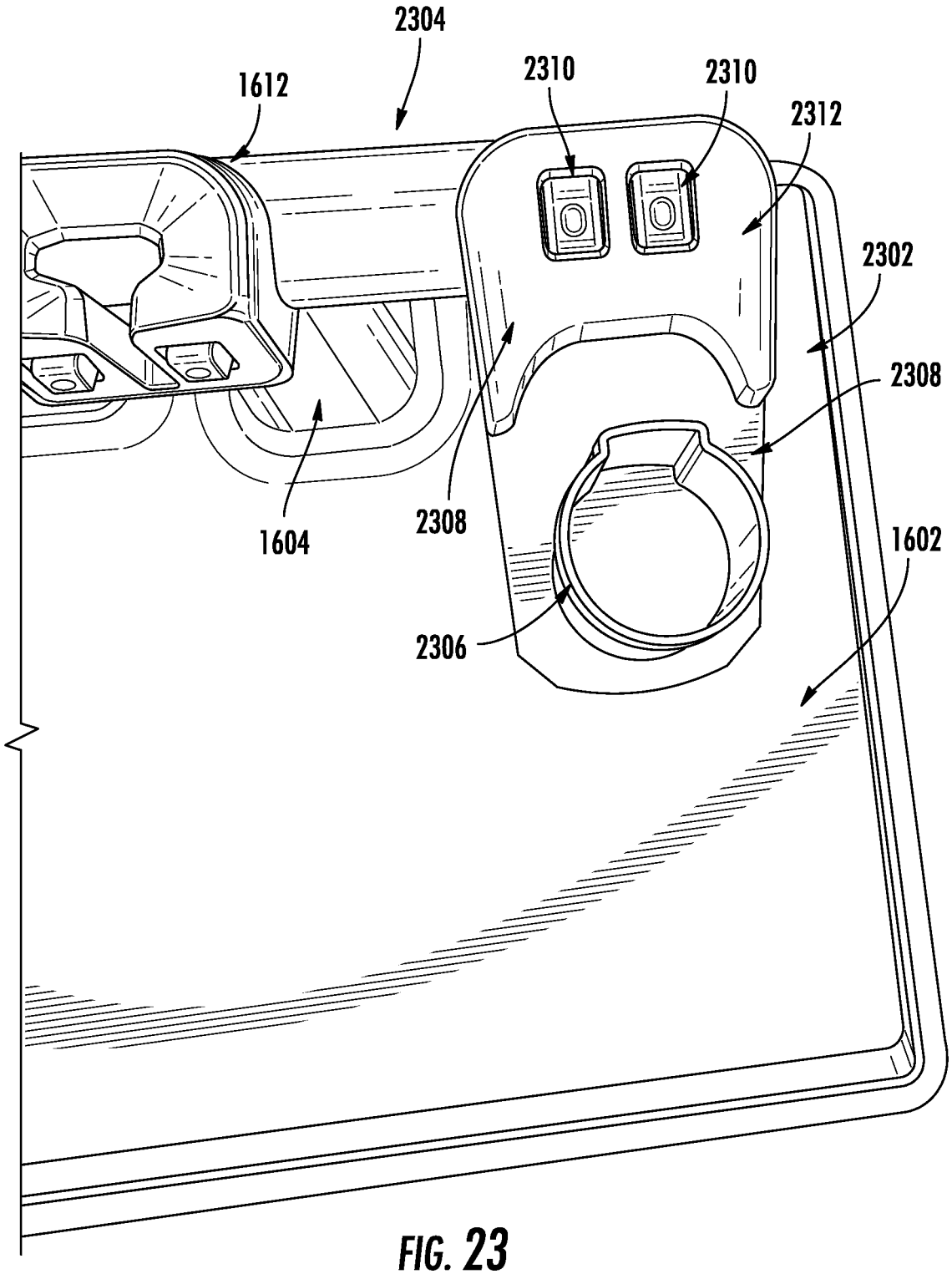
FIG. 23 generally illustrates one example of the second base coupler of FIG. 14, consistent with embodiments of the present disclosure.
Figure 27:
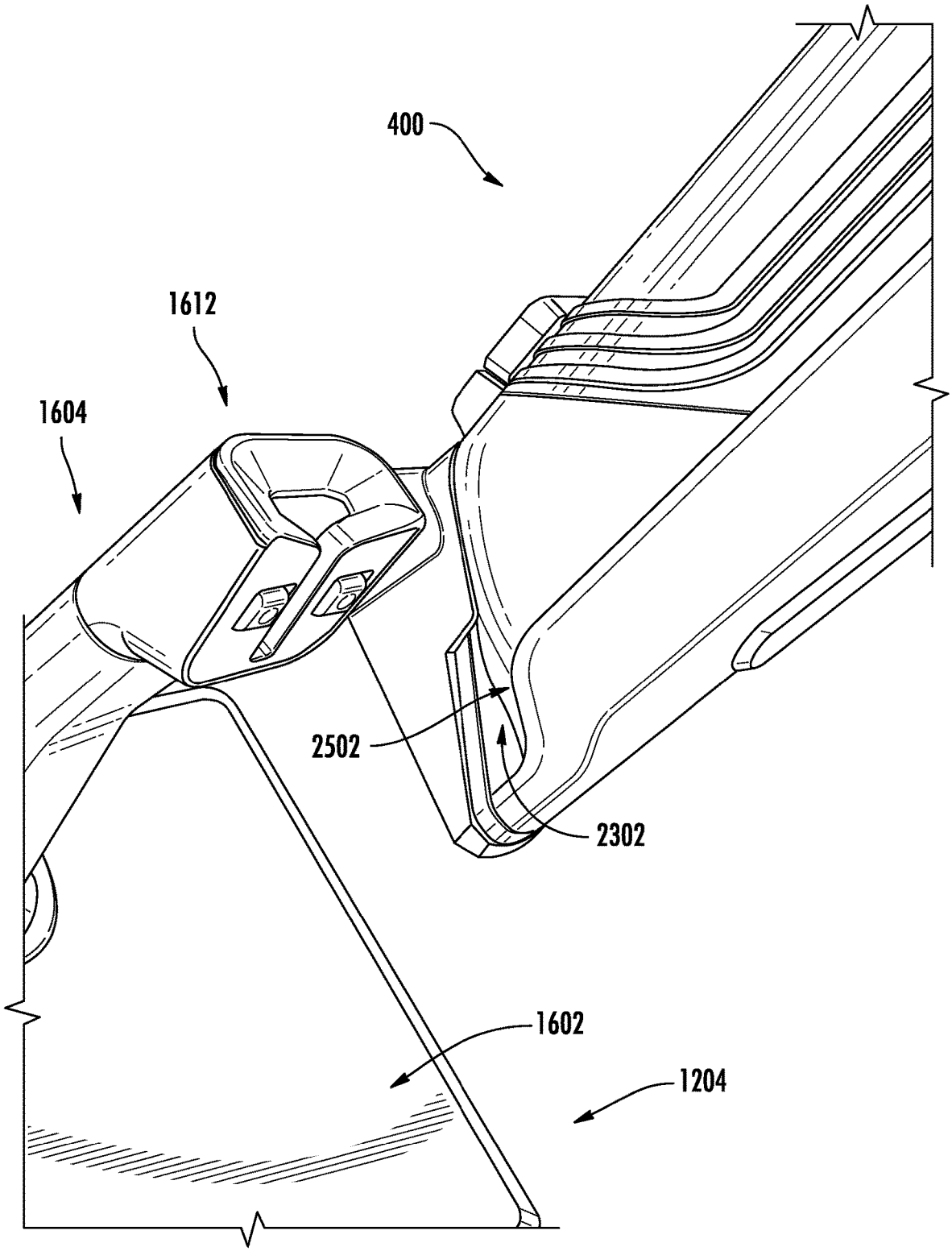
FIG. 27 generally illustrates the vacuum cleaner and docking station in the second docked state, consistent with embodiments of the present disclosure.

The second base coupler 2302 may be configured to receive at least a portion of the vacuum coupler 2502 to secure a least a portion of the vacuum cleaner 400 to the docking station 1204 in the second docked state, e.g., as generally illustrated in FIG. 27. With reference to FIGS. 16A, 16B and 23, the second base coupler 2302 may be coupled to the support arm 1604. For example, the second base coupler 2302 may be coupled to the support arm 1604 by way of one or more vacuum arms 2304. The vacuum arm 2304 may extend from the support arm 1604 and position the second base coupler 2302 to a location that allows the vacuum cleaner 400 to be coupled to the second base coupler 2302 in the second docked state at the same time as the wand 700 and surface cleaning head 1202 are coupled to the first base coupler 1612 in the first docked state. The vacuum arm 2304 may also extend from the support arm 1604 and position the second base coupler 2302 to a location which allows the vacuum cleaner 400 to be easily grasped and removed (e.g., undocked) by the user without having to remove (e.g., undock) the wand 700 and surface cleaning head 1202 from the first base coupler 1612.

Figure 25:
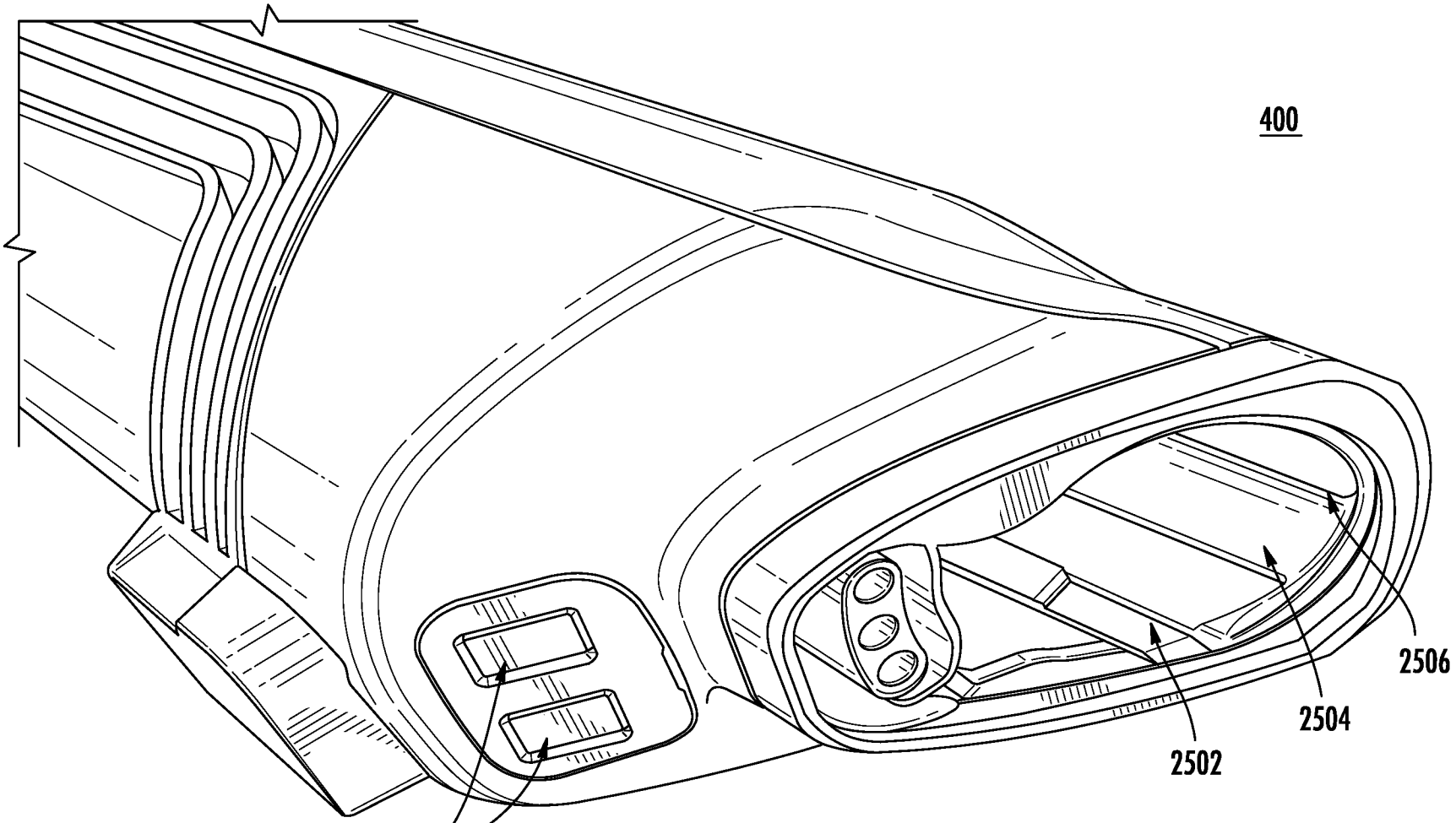
FIG. 25 generally illustrates another view of the vacuum coupler, consistent with embodiments of the present disclosure.
Figure 26:
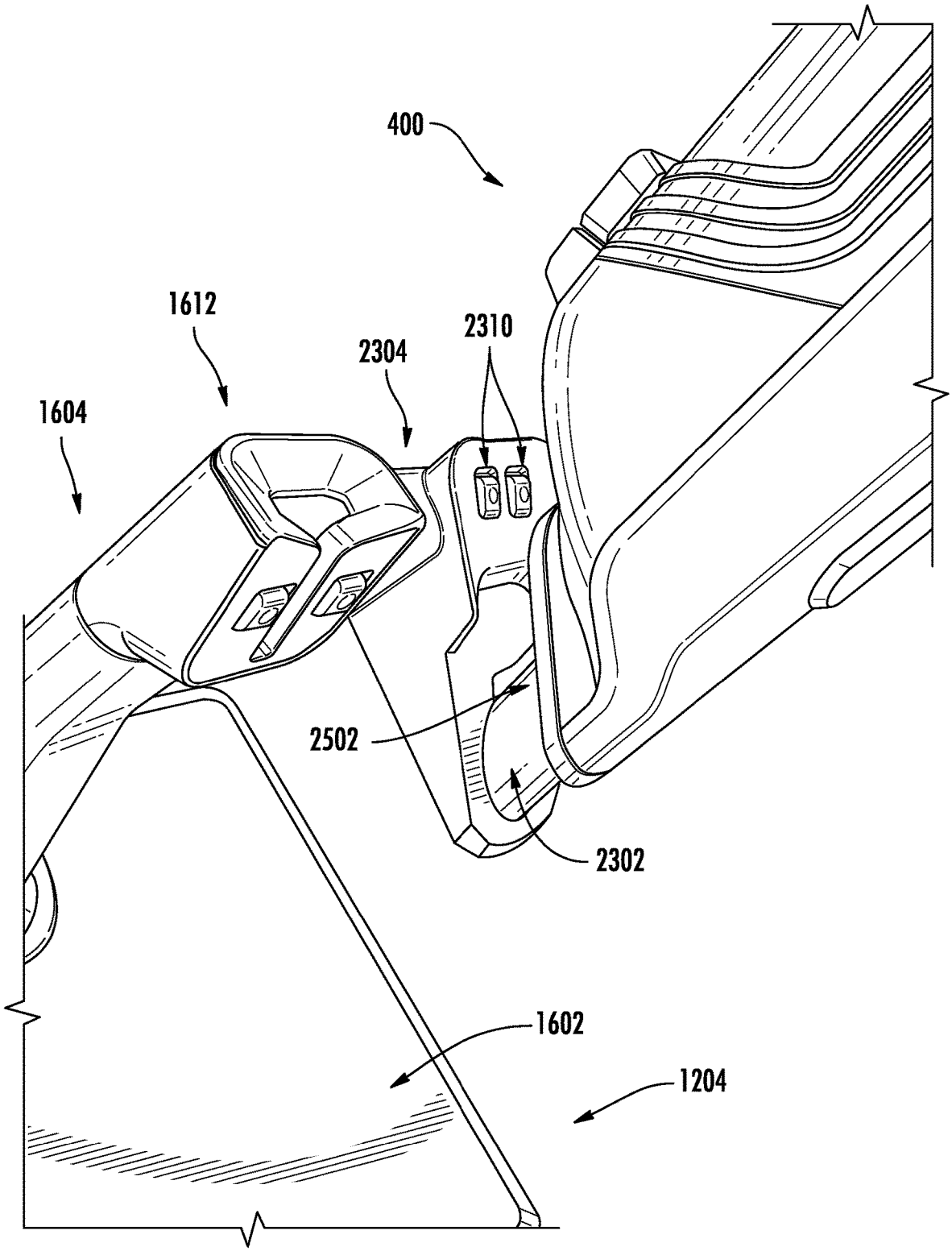
FIG. 26 generally illustrates the vacuum cleaner being advanced towards the docking station to the second docked state, consistent with embodiments of the present disclosure.

In the illustrated example (best seen in FIGS. 16A, 16B and 23), the second base coupler 2302 may include a vacuum protrusion 2306 that extends outward from a pedestal 2308. The vacuum protrusion 2306 may be configured to be at least partially received in a corresponding vacuum cavity 2504 (FIG. 25) of the vacuum coupler 2502, e.g., as generally illustrated in FIGS. 26-27. In particular, FIG. 26 generally illustrates the vacuum protrusion 2306 partially received in the vacuum cavity 2504, and FIG. 27 generally illustrates the vacuum cleaner 400 in a completely docked state. In the illustrated example, the pedestal 2308 may be configured to contact a portion of the vacuum cleaner 400 when fully docked. At least a portion of the pedestal 2308 may optionally have a surface contour/configuration that generally corresponds to the portion of the vacuum cleaner 400 that contacts the pedestal 2308. It should be appreciated, however, that the vacuum cleaner 400 does not have to contact the pedestal 2308. Additionally, the vacuum protrusion 2306 and/or the vacuum cavity 2504 may have a tapered profile. For example, the vacuum protrusion 2306 may have a taper that reduces from the pedestal 2308 toward the distal end, and the vacuum cavity 2504 may have a taper that increases from the opening toward the opposite end. Such a tapered configuration may aid in aligning the vacuum cleaner 400 relative to the docking station 1204. In the exemplary embodiment, the vacuum cavity 2504 may also include a portion of the vacuum inlet 2506 to the vacuum cleaner 400 (which may also function to be fluidly coupled the wand 700).

While the second base coupler 2302 is shown coupled to the support arm 1604, it should be appreciated that the second base coupler 2302 may be coupled to any portion of the docking station 1204. For example, the vacuum arm 2304 may extend directly from the support base 1602 (e.g., the vacuum arm 2304 may not extend from the support arm 1604). Alternatively (or in addition), the second base coupler 2302 may be coupled directly to the support base 1602 (i.e., without the vacuum arm 2304).

Figure 24:
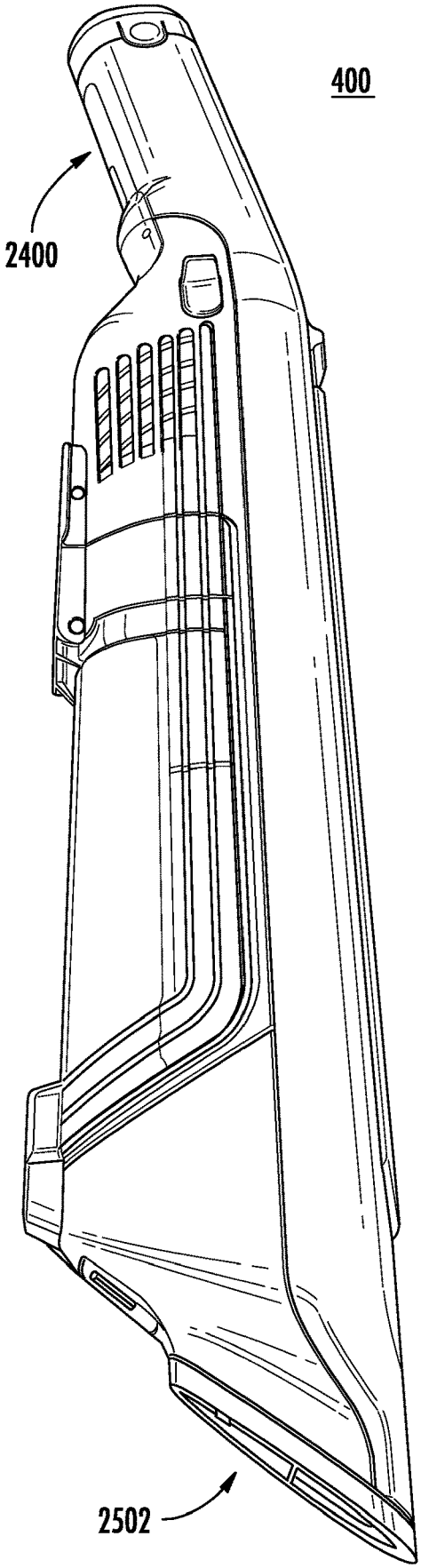
FIG. 24 generally illustrates one example of the vacuum coupler of FIG. 14, consistent with embodiments of the present disclosure.

The second base coupler 2302 may optionally include one or more docking charging terminals 2310 configured to be electrically coupled to corresponding vacuum charging terminals 2508 associated with the vacuum cleaner 400 when the vacuum cleaner 400 is in the docked state. The docking charging terminals 2310 and vacuum charging terminals 2508 may be configured to supply electrical power to one or more batteries associated with the vacuum cleaner 400. The batteries may be located anywhere in the vacuum cleaner 400 such as, but not limited to, the handle 2400 (FIG. 24). The second base coupler 2302 may be configured to be coupled to the corresponding vacuum coupler 2502 to generally align the docking charging terminals 2310 with the vacuum charging terminals 2508 when the vacuum cleaner 400 is in the docked state.

In at least one example, one or more of the docking charging terminals 2310 may be at least partially disposed on an outer surface 2312 of the second base coupler 2302. For example, one or more of the docking charging terminals 2310 may be disposed on the pedestal 2308 of the second base coupler 2302. Alternatively (or in addition), one or more of the docking charging terminals 2310 may be at least partially disposed on/in the vacuum protrusion 2306.

An example of a cleaning system, consistent with the present disclosure, includes a cleaning assembly and a docking station. The cleaning system includes a vacuum cleaner, a surface cleaning head, a wand configured to be fluidly coupled to the surface cleaning head and the vacuum cleaner, the wand including a vacuum coupler and one or more vacuum charging terminals, a cleaning assembly coupler, and one or more vacuum charging terminals. The docking station includes a support base, the support base having a lower surface to be disposed on a floor and an upper surface, a support arm extending from the support base, the support arm further including a first base coupler configured to be secured to the cleaning assembly coupler to secure at least one of the wand or the surface cleaning head of the cleaning assembly to the docking station in a first docked state, one or more first docking charging terminals configured to be electrically coupled to the one or more vacuum charging terminals when the cleaning assembly is in the first docked state, a second base coupler configured to be secured to the vacuum coupler to secure the vacuum cleaner to the docking station in a second docked state, and one or more second docking charging terminals configured to be electrically coupled to the one or more vacuum charging terminals when the vacuum cleaner is in the second docked state.

In some instances, the second base coupler may be coupled to the support arm. In some instances, the cleaning system may further include a vacuum arm extending outward from the support arm, the vacuum arm configured to couple to the second base coupler to the support arm. In some instances, the second base coupler may include a vacuum protrusion that extends outward from a pedestal. In some instances, the vacuum protrusion may be configured to be at least partially received in a vacuum cavity of the vacuum coupler. In some instances, the vacuum cavity may include a portion of a vacuum inlet to the vacuum cleaner. In some instances, the vacuum arm may be configured to position the second base coupler such that the vacuum cleaner can be coupled to the second base coupler in the second docked state at the same time as the wand and the surface cleaning head are coupled to the first base coupler in the first docked state. In some instances, the first base coupler may be configured to be coupled to the wand and the surface cleaning head in the first docked state at the same time as the second base coupler is coupled to the vacuum cleaner in the second docked state. In some instances, the one or more first docking charging terminals may be configured to supply electrical power to one or more batteries disposed in the vacuum cleaner when the cleaning assembly is in the first docked state and wherein the one or more second docking charging terminals are configured to supply electrical power to the one or more batteries when the vacuum cleaner is in the second docked state. In some instances, the first base coupler and the cleaning assembly coupler may be configured to allow the surface cleaning head to contact the support base when in the first docked state. In some instances, the first base coupler and the cleaning assembly coupler may be configured to allow the wand to extend generally upright from the support base when in the first docked state. In some instances, the first base coupler may include a cavity and the cleaning assembly coupler includes a rib, wherein the rib is configured to be at least received in the cavity when in the first docking state.

An example of a vacuum cleaner docking station for use with a cleaning assembly including a vacuum cleaner, a wand, and a surface cleaning head, consistent with the present disclosure, includes a support base, the support base having a lower surface to be disposed on a floor and an upper surface, a support arm extending from the support base, the support arm further comprising a first base coupler configured to be secured to a cleaning assembly coupler of the cleaning assembly to secure at least one of the wand or the surface cleaning head of the cleaning assembly to the docking station in a first docked state, one or more first docking charging terminals configured to be electrically coupled to one or more vacuum charging terminals of the cleaning assembly when the cleaning assembly is in the first docked state, a second base coupler configured to be secured to a vacuum coupler of the vacuum cleaner to secure the vacuum cleaner to the docking station in a second docked state, and one or more second docking charging terminals configured to be electrically coupled to one or more vacuum charging terminals of the vacuum cleaner when the vacuum cleaner is in the second docked state.

In some instances, the second base coupler may be coupled to the support arm. In some instances, a vacuum arm may extend outward from the support arm, the vacuum arm configured to couple to the second base coupler to the support arm. In some instances, the vacuum arm may be configured to position the second base coupler such that the vacuum cleaner can be coupled to the second base coupler in the second docked state at the same time as the wand and the surface cleaning head are coupled to the first base coupler in the first docked state. In some instances, the first base coupler may be configured to be coupled to the wand and the surface cleaning head in the first docked state at the same time as the second base coupler is coupled to the vacuum cleaner in the second docked state. In some instances, the one or more first docking charging terminals may be configured to supply electrical power to one or more batteries disposed in the vacuum cleaner when the cleaning assembly is in the first docked state and wherein the one or more second docking charging terminals are configured to supply electrical power to the one or more batteries when the vacuum cleaner is in the second docked state. In some instances, the first base coupler may be configured to allow the surface cleaning head to contact the support base when in the first docked state. In some instances, the first base coupler may be configured to allow the wand to extend generally upright from the support based when in the first docked state.

An example of a vacuum cleaner, consistent with the present disclosure, includes a body having a handle end and an attachment end, the attachment end being opposite the handle end along a longitudinal axis of the body, a dust cup disposed between the handle end and the attachment end, a suction motor disposed between the handle end and the attachment end, a body latch configured to releasably engage an accessory, and a body toggle configured to cause the body latch to transition between a releasing position and a retaining position, the body toggle being positioned closer to the handle end than the attachment end.

In some instances, the vacuum cleaner may further include a body pull-rod configured to engage the body latch. In some instances, the vacuum cleaner may further include a body pushrod configured to engage the body latch. In some instances, the body latch may be urged towards the retaining position by a biasing mechanism. In some instances, the body toggle may be vertically spaced apart from the body latch. In some instances, the body toggle may be longitudinally spaced apart from the body latch. In some instances, the body toggle may be horizontally spaced apart from the body latch in a direction transverse to the longitudinal axis of the body.

An example of a cleaning assembly, consistent with the present disclosure, includes a vacuum cleaner, a wand fluidly coupled to the vacuum cleaner, and a surface cleaning head fluidly coupled to the wand. The vacuum cleaner includes a body having a handle end and an attachment end, the attachment end being opposite the handle end along a longitudinal axis of the body, a dust cup disposed between the handle end and the attachment end, a suction motor disposed between the handle end and the attachment end, a body latch configured to releasably engage the wand, and a body toggle configured to cause the body latch to transition between a releasing position and a retaining position, the body toggle being closer to the handle end than the attachment end.

In some instances, the vacuum cleaner may further include a body pull-rod configured to urge the body latch to transition from the retaining position and toward the releasing position. In some instances, the vacuum cleaner may further include a body pushrod configured to urge the body latch to transition from the retaining position and toward the releasing position. In some instances, the body latch may be urged towards the retaining position by a biasing mechanism. In some instances, the body toggle may be vertically spaced apart from the body latch. In some instances, the body toggle may be longitudinally spaced apart from the body latch. In some instances, the body toggle may be horizontally spaced apart from the body latch in a direction transverse to the longitudinal axis of the body. In some instances, the wand may include a wand catch configured to engage the body latch. In some instances, the wand may include a wand toggle configured to actuate a wand latch. In some instances, the wand latch may couple to a connector of the surface cleaning head. In some instances, the wand toggle may be spaced apart from the vacuum cleaner by a distance less than a wand toggle length.

An example of a cleaning system, consistent with the present disclosure, includes a docking station and a cleaning assembly configured to couple to the docking station. The cleaning assembly includes a vacuum cleaner, a wand fluidly coupled to the vacuum cleaner, and a surface cleaning head fluidly coupled to the wand. The vacuum cleaner includes a body having a handle end and an attachment end, the attachment end being opposite the handle end along a longitudinal axis of the body, a dust cup disposed between the handle end and the attachment end, a suction motor disposed between the handle end and the attachment end, a body latch configured to releasably engage the wand, and a body toggle configured to cause the body latch to transition between a releasing position and a retaining position, the body toggle being closer to the handle end than the attachment end.

In some instances, the vacuum cleaner may be configured to be separable from the wand while the wand and the surface cleaning head are coupled to the docking station.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

a body having a longitudinal axis extending through a handle end and an attachment end, the attachment end being opposite the handle end along the longitudinal axis of the body, the attachment end being configured to be removably coupled to an accessory and including a suction inlet;

a dust cup disposed between the handle end and the attachment end;

a suction motor disposed between the handle end and the attachment end and configured to be fluidly coupled to the suction inlet;

a body latch positioned at least partially within the body adjacent the attachment end;

a first and a second body toggle disposed on a first and a second opposite side of the body and positioned closer to the handle end than the attachment end, the first and second body toggles configured to cause the body latch to transition between:

a retaining position in which the body latch couples the accessory to the suction inlet such that the suction inlet is fluidly coupled to the accessory; and a releasing position in which the body latch disengages the accessory such that the suction inlet is not fluidly coupled to the accessory; and a linkage connecting the body latch to both the first and second body toggles, the linkage being positioned at least partially within the body.

2. The vacuum cleaner of claim 1, wherein the linkage comprises a body pull-rod configured to engage the body latch.

3. The vacuum cleaner of claim 1, wherein the linkage comprises a body pushrod configured to engage the body latch.

4. The vacuum cleaner of claim 1, wherein the body latch is urged towards the retaining position by a biasing mechanism.

5. The vacuum cleaner of claim 1, wherein the first and second body toggles are vertically spaced apart from the body latch.

6. The vacuum cleaner of claim 5, wherein the first and second body toggles are longitudinally spaced apart from the body latch.

7. The vacuum cleaner of claim 6, wherein the first and second body toggles are horizontally spaced apart from the body latch in a direction transverse to the longitudinal axis of the body.

8. A cleaning assembly comprising:
- a vacuum cleaner;
- a wand fluidly coupled to the vacuum cleaner; and
- a surface cleaning head fluidly coupled to the wand, the vacuum cleaner including:
  - a body having a longitudinal axis extending through a handle end and an attachment end, the attachment end being opposite the handle end along the longitudinal axis of the body, the attachment end being configured to be removably coupled to the wand and including a suction inlet;
  - a dust cup disposed between the handle end and the attachment end;
  - a suction motor disposed between the handle end and the attachment end and configured to be fluidly coupled to the suction inlet;
  - a body latch positioned at least partially within the body adjacent the attachment end;
  - a first and a second body toggle disposed on a first and a second opposite side of the body and positioned closer to the handle end than the attachment end, the first and second body toggles configured to cause the body latch to transition between:
    - a retaining position in which the body latch couples the wand to the suction inlet such that the suction inlet is fluidly coupled to the wand; and
    - a releasing position in which the body latch disengages the wand such that the suction inlet is not fluidly coupled to the wand; and
- a linkage connecting the body latch to both the first and second body toggles, the linkage being positioned at least partially within the body.

9. The cleaning assembly of claim 8, wherein the linkage comprises a body pull-rod configured to urge the body latch to transition from the retaining position and toward the releasing position.

10. The cleaning assembly of claim 8, wherein the linkage comprises a body pushrod configured to urge the body latch to transition from the retaining position and toward the releasing position.

11. The cleaning assembly of claim 8, wherein the body latch is urged towards the retaining position by a biasing mechanism.

12. The cleaning assembly of claim 8, wherein the first and second body toggles are vertically spaced apart from the body latch.

13. The cleaning assembly of claim 12, wherein the first and second body toggles are longitudinally spaced apart from the body latch.

14. The cleaning assembly of claim 13, wherein the first and second body toggles are horizontally spaced apart from the body latch in a direction transverse to the longitudinal axis of the body.

15. The cleaning assembly of claim 8, wherein the wand includes a wand catch configured to engage the body latch.

16. The cleaning assembly of claim 8, wherein the wand includes a wand toggle configured to actuate a wand latch.

17. The cleaning assembly of claim 16, wherein the wand latch couples to a connector of the surface cleaning head.

18. The cleaning assembly of claim 17, wherein the wand toggle is spaced apart from the vacuum cleaner by a distance less than a wand toggle length.

19. A cleaning system comprising:
- a docking station; and
- a cleaning assembly configured to couple to the docking station, the cleaning assembly including:
  - a vacuum cleaner;
  - a wand fluidly coupled to the vacuum cleaner; and
  - a surface cleaning head fluidly coupled to the wand, the vacuum cleaner including:
    - a body having a longitudinal axis extending through a handle end and an attachment end, the attachment end being opposite the handle end along the longitudinal axis of the body, the attachment end being configured to be removably coupled to the wand and including a suction inlet;
    - a dust cup disposed between the handle end and the attachment end;
    - a suction motor disposed between the handle end and the attachment end and configured to be fluidly coupled to the suction inlet;
    - a body latch positioned at least partially within the body adjacent the attachment end;
    - a first and a second body toggle disposed on a first and a second opposite side of the body and positioned closer to the handle end than the attachment end, the first and second body toggles configured to cause the body latch to transition between:
      - a retaining position in which the body latch couples the wand to the suction inlet such that the suction inlet is fluidly coupled to the wand; and
      - a releasing position in which the body latch disengages the wand such that the suction inlet is not fluidly coupled to the wand; and
  - a linkage connecting the body latch to both the first and second body toggles, the linkage being positioned at least partially within the body.

20. The cleaning system of claim 19, wherein the vacuum cleaner is configured to be separable from the wand while the wand and the surface cleaning head are coupled to the docking station.

* * * * *